US012635797B2

(12) United States Patent
Stavenow et al.

(10) Patent No.: US 12,635,797 B2
(45) Date of Patent: May 26, 2026

(54) OUTDOOR FURNITURE AND COMPONENTS THEREOF

(71) Applicant: Dotchi, LLC, Miami, FL (US)

(72) Inventors: Elin Stavenow, Copenhagen (DK); Lars Larsen, Copenhagen (DK); Harry Tchira, Miami, FL (US); Claus Molgaard, Copenhagen (DK)

(73) Assignee: Dotchi, LLC, Miami, FL (US)

( * ) Notice: Subject to any disclaimer, the term of this patent is extended or adjusted under 35 U.S.C. 154(b) by 257 days.

(21) Appl. No.: 18/622,436

(22) Filed: Mar. 29, 2024

(65) Prior Publication Data

US 2024/0324778 A1 Oct. 3, 2024

Related U.S. Application Data

(60) Provisional application No. 63/493,148, filed on Mar. 30, 2023.

(51) Int. Cl.

| | |
|---|---|
| ***A47C 7/66*** | (2006.01) |
| ***A47C 1/14*** | (2006.01) |
| ***A47C 4/02*** | (2006.01) |
| ***A47C 11/00*** | (2006.01) |

(52) U.S. Cl.

CPC ..... *A47C 1/14* (2013.01); *A47C 4/028* (2013.01); *A47C 11/005* (2013.01)

(58) Field of Classification Search

CPC ..... A47C 1/14; A47C 4/028; A47C 11/005; A47C 13/005; A47C 31/02; A47C 7/66

See application file for complete search history.

(56) References Cited

U.S. PATENT DOCUMENTS

| | | | | |
|---|---|---|---|---|
| 2,208,745 | A * | 7/1940 | Bloomberg | A47C 7/185 297/452.25 |
| 3,630,570 | A * | 12/1971 | Swenson | B60N 2/56 297/452.46 |
| 5,005,241 | A | 4/1991 | Difloe | |
| 9,468,573 | B2 * | 10/2016 | Edwards | A61G 7/1059 |
| 11,229,567 | B2 * | 1/2022 | Veloz | A61G 7/1003 |
| 11,607,084 | B2 * | 3/2023 | Williams | A47K 3/282 |
| 12,414,633 | B1 * | 9/2025 | Song | A47C 17/23 |
| 2008/0196154 | A1 | 8/2008 | Felmeri | |
| 2012/0233767 | A1 | 9/2012 | Liu | |

FOREIGN PATENT DOCUMENTS

| | | |
|---|---|---|
| CN | 201759452 | 3/2011 |
| FR | 2542180 | 9/1984 |

* cited by examiner

*Primary Examiner* — Brian M O'Hara

(74) *Attorney, Agent, or Firm* — PABST PATENT GROUP LLP

(57) ABSTRACT

Individual items of furniture and components thereof are described herein. The furniture can be used as individual pieces or connected to form a furniture system. A seat module is attached to three or four legs to form a chair; optionally the legs are part of a leg module. Two or more seat modules can be connected using a connection system to form a sectional, such as a multi-seat sofa. Each seat module is connected to one or more legs via the same or a different connection system. Each furniture system or item of furniture contains at least one seat module. The seat portion of each seat module typically contains one or more slots configured to facilitate drainage. A seat cushion can be placed on the top surface of the seat portion and is held in place via a plug that inserts into a top opening in the seat portion.

20 Claims, 23 Drawing Sheets

OUTDOOR FURNITURE AND COMPONENTS THEREOF

CROSS REFERENCE TO RELATED APPLICATION

This application claims priority to U.S. Application No. 63/493,148, filed Mar. 30, 2023, the disclosure of which is incorporated herein by reference.

FIELD OF THE INVENTION

The disclosed invention is generally in the field of furniture and specifically in the area of outdoor furniture.

BACKGROUND OF THE INVENTION

Outdoor furniture, such as chairs and couches, can include seat cushions to improve comfort and/or appearance of the furniture. The seat cushion can be removable, to facilitate cleaning. Additionally, the removable cushion can be replaced with another cushion with a different material, color, and/or pattern to change the style or appearance of the furniture.

However, if seat cushions remain on the outdoor furniture during a storm, water can underneath the cushion, creating an environment that facilitates the breeding and proliferation of mosquitoes, mold and algae.

Seat cushions may be secured to the chair or couch using Velcro, ties, and/or straps. However, during a storm, the cushions can become detached due to the force of the wind, causing the fabric to rip, and thereby damaging the cushions.

There is a need for improved outdoor furniture with removable cushions.

SUMMARY OF THE INVENTION

Individual items of furniture and components thereof are described herein. The Furniture can be used as individual pieces or can be connected to form a furniture system. Optionally, the furniture system is modular, allowing different configurations to be created and parts to be replaced, as needed. The furniture items are generally different forms of seats, such as chairs, sofas, and/or ottomans, which optionally contain a removable seat cushion.

A seat module is attached to three or four legs, optionally the legs are part of a leg module. Thus a seat module can be attached to two leg modules to form a chair. Two or more seat modules can be connected to each other using a connection system to form a sectional, such as a sofa, such as a two-seat sofa, three-seat sofa, or four-seat sofa. Each seat module is connected to one or more legs via the same or a different connection system.

Each furniture system or individual item of furniture contains at least one seat module.

The seat portion of each seat module typically contains one or more openings, optionally in the form of a slot, in the top surface and bottom surface of the seat portion that are configured to facilitate drainage. The top opening is optionally in the form of a slot that is configured to receive the bottom portion of a plug. The top opening can have a suitable size and shape to receive the bottom portion of a plug, and permit water to flow through the slot when the bottom portion of the plug is inside the slot.

A seat cushion can be placed on the top surface of the seat portion. The seat cushion optionally is held in place on the top surface of the seat portion for example, via a plug configured to fit in the top opening, optionally in the form of a slot, such as to prevent the seat cushion from sliding off the seat.

BRIEF DESCRIPTION OF THE DRAWINGS

The accompanying drawings illustrate several embodiments of the disclosed furniture and components and together with the description serve to explain the principles of the disclosed furniture, components thereof and methods of use.

FIG. 1A is a top perspective view and FIG. 1B is a bottom perspective view of the exemplary seat module 100. FIG. 1C is a bottom view of the exemplary seat module. FIG. 1D is a side cross-sectional view of the exemplary chair. FIG. 1E is an enlarged side cross sectional view of the region denoted with a circle in FIG. 1D showing the top slot 116, the gutter 115, and the bottom opening 117 to guide water to flow through the seat module. FIG. 1F is a front cross-sectional view of the chair depicted in FIG. 1D. FIG. 1G is an enlarged front cross-sectional view of the region denoted with a circle in FIG. 1F.

FIG. 3A is a top perspective view and FIG. 3B is a bottom perspective view of the exemplary plug 200. FIG. 3C is a cross-sectional view of the exemplary plug 200. FIG. 3D is a side view of the exemplary plug depicted in FIGS. 3A-3C showing the bottom portion, which contains two defined channels 230*a* and 230*b* to facilitate the flow of water. FIGS. 3E and 3F correspond with FIGS. 3B and 3C, respectively, and illustrate the flow of water flow along the channels 230*a* and 230*b* of the plug.

As shown in FIG. 3G, the bottom portion of the plug fits into the slot of the seat module.

FIG. 4A is an exploded view of the exemplary seat cushion 300. FIG. 4B is a top view of the exemplary seat cushion cover 305. FIG. 4C is a side view of the exemplary seat cushion 300. FIG. 4D is a bottom view of the exemplary seat cushion showing a zipper 340 positioned between the first material 322 and second material 324 of the back portion 320. FIG. 4E is a perspective view of an exemplary seat cushion showing the elements of the back portion 320 of the seat cushion cover 305.

FIGS. 10A and 10B are a front view and a side views. FIGS. 10C and 10D are magnified views of the encircled regions of FIGS. 10A and 10B, respectively.

FIG. 11A is the same cross sectional view as shown in FIG. 10B, however a cushion is on top of the seat portion of the side chair. FIG. 11B is the same magnified view of the encircled region in FIG. 10B with a plug inside the slot.

FIGS. 12A and 12B are a perspective and front view, respectively, of the exemplary armchair, shown without a seat cushion. FIGS. 12C and 12D are a perspective and front view, respectively, of the exemplary armchair with a seat cushion.

FIG. 13A is a top perspective view of the exemplary ottoman or seat that does not contain a backrest portion, shown without a seat cushion. FIG. 13B is a top perspective view of the exemplary ottoman or seat that does not contain a backrest portion with a seat cushion.

FIG. 14A is a top perspective view, and FIG. 14B is a bottom perspective view.

FIG. 15A is a top perspective view, and FIG. 15B is a bottom perspective view.

FIG. 16A is a side cross-sectional view, and FIGS. 16B and 16C are magnified views of the encircled regions in FIG. 16A.

FIG. 17A is a bottom view and FIG. 17B is an exploded top perspective view of the exemplary seat cushion with the attachment region for the plug shown separately from the cushion Corresponding reference characters indicate corresponding components throughout the several views of the drawings. Skilled artisans will appreciate that elements in the figures are illustrated for simplicity and clarity and that not all components or elements of an item of furniture are shown in each figure to more clearly show aspects of the item of furniture or component thereof. Also, common but well-understood elements that are useful or ornamental in a commercial embodiment are often not depicted in order to facilitate a less obstructed view of these various embodiments of the present invention.

Figure 1C:
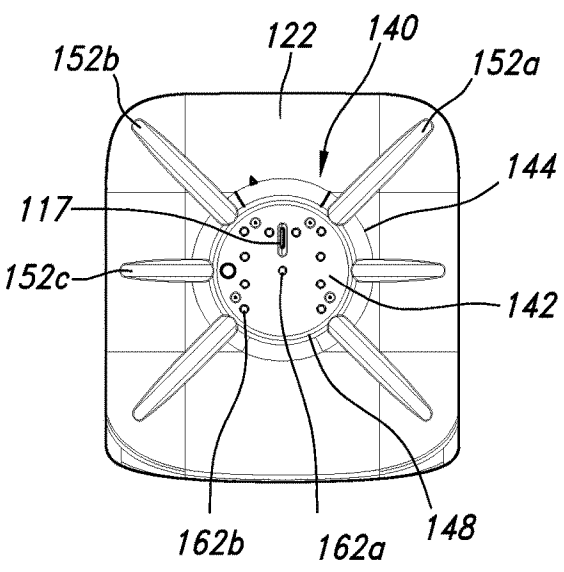
FIGS. 1A-1C are different views of an exemplary seat module.
Figure 1B:
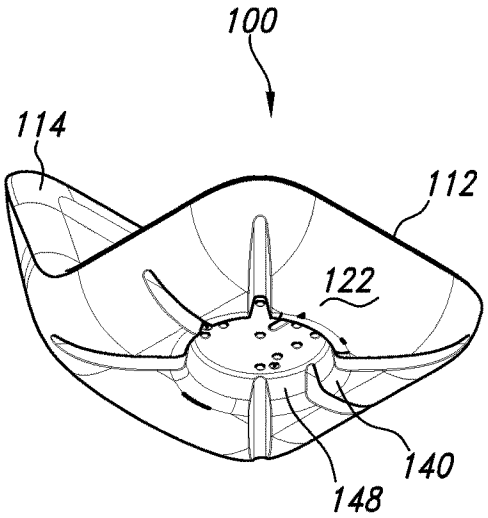
Figure 1A:
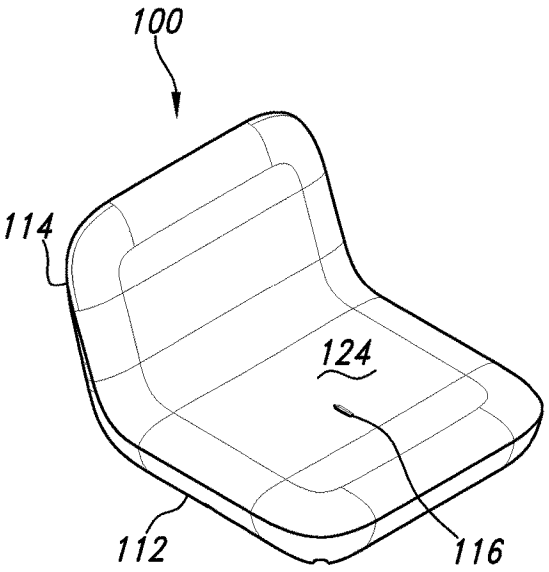

It will be appreciated that the drawings are illustrative and not limiting of the scope of the invention. It is appreciated that it is not possible to clearly show each element or advantage in a single figure, and as such, multiple figures are presented to separately illustrate the various details of the examples in greater clarity. Similarly, not every example need accomplish all advantages of the present disclosure.

DETAILED DESCRIPTION OF THE INVENTION

I. Furniture

The furniture described herein is suitable for use both indoors and outside. The furniture can be used as individual, separate pieces of furniture, or can be part of a furniture system. Optionally, the furniture system is modular, which allows different configurations to be created and/or parts to be replaced, as needed. The modular furniture system is suitable for combining a multiple of modules into a plurality of furniture combinations. For example, a modular furniture system contains a first seat module and two leg modules. Optionally the system a second seat module. Optionally the system contains a first seat module that is in the form of a corner seat and a second seat module in the form of a side seat. Optionally the system contains two or more seat modules in the form of side seats. Optionally the system also contains one or two seat modules in the form of corner seats.

The system typically contains two leg modules for each seat module. Typically each leg module contains a connecting bar and two legs, where each leg is attached to an opposite side of the connecting bar. However, in some embodiments, a seat module that is in the form of a corner seat is attached to a first leg module containing two legs and a second leg module that contains a single leg.

The modular furniture systems can be arranged in a variety of configurations and lengths using the components described herein. Additionally, the cushions on the seats, chairs, ottomans, and/or sofas are removable, to facilitate long-term use, cleaning, and replacement, as needed, such as to modify the style or appearance of the furniture by replacing one or more cushions covered with one material or pattern with one or more different cushions covered in a different material or pattern.

A single seat module can be attached to one or more leg modules, optionally two leg modules, to form a chair.

Two or more seat modules can be connected to each other using a connection system to form a sectional, such as a sofa, such as a two-seat sofa, three-seat sofa, or four-seat sofa. Each seat module is connected to one or more legs via the same or a different connection system. Optionally, the components in a modular furniture system can be disassembled and re-assembled as needed. When disassembled, the components of the modular furniture system are optionally light weight, easily packaged, and/or transported.

A. Seat Module

The furniture contains at least one seat module. Optionally a first seat module is connected to a second seat module having the same depth and height. The first seat module and the second seat module can have the same shape or different shapes.

The seat module can be formed from any suitable material, such as polypropylene, polyethylene, polyurethane, etc. Optionally the seat module is formed one or more layers of polyethylene. The seat module may be hollow in the inside. This is particularly useful to reduce the overall weight of the furniture. Optionally the seat module or one or more parts of it are solid or filled with a different material than the outer surface of the seat module. In some forms, the seat module is formed via rotational molding. In some forms, the seat module is formed of two layers of polyethylene. Optionally, the inner layer is formed of foamed polyethylene to increase stiffness and shock absorbance of the seat module, and/or reduce vibrations and sound reverberations when the seat module is hollow.

Each seat module typically contains a seat portion. The seat portion of the seat module can have any suitable shape, for example, such as a circle, oval, square, rectangle, star, heart, flower, etc. The shape can be symmetrical or asymmetrical. Optionally, the shape is a symmetrical shape, optionally the shape is a rectangle.

Optionally the seat module includes a backrest portion. In some forms, the seat module contains a seat portion and does not contain a backrest portion. Such seat modules can be used as a stool, bench, footrest, and/or ottoman.

Seat modules that contain a seat portion and a backrest portion optionally have suitable dimensions to facilitate ergonomics. For example, the sum of seat depth and seat height is about 800 mm to about 950 mm, such as from about 850 mm to about 950 mm, such as from about 850 mm to about 900 mm, optionally from about 870 to about 900 mm. For seat modules that contain a seat portion and a backrest portion, the backrest portion is generally aligned with the seat portion at an angle of about 90° or greater, and less than 180°.

In some embodiments, the seat portion has a width in the range from about 500 mm to 650 mm, such as from about 500 mm to 550 mm, from about 520 mm to about 550 mm, from about 550 to about 650 mm, from about 600 to about 650 mm, or from about 620 mm to about 650 mm.

In some embodiments, the seat portion has a depth in the range from about 500 mm to 600 mm, such as from about 500 mm to 550 mm, from about 520 mm to about 600 mm, from about 520 to about 550 mm, from about 530 to about 560 mm, or from about 530 mm to about 550 mm.

Embodiments in which the seat module contains a seat portion and a backrest portion are generally referred to as a side seat module. When legs are attached to the side seat module the furniture is referred to herein as a side chair.

A corner seat module contains a seat portion, a backrest portion, and a side portion. The backrest portion and the side portion each lie in a different plane that intersects with the top surface of the seat portion at the same or substantially the same angle. The plane in which backrest portion lies and the plane in which the side portion lies optionally intersect with each other at an angle of 90° or greater and less than 180°, typically at an angle greater than 90° and less than 180°, such as greater than 90° and less than 170°, greater than 90° and less than 160°, greater than 90° and less than 150°, greater than 90° and less than 140°, greater than 90° and less than 130°, greater than 90° and less than 120°, or greater than 90° and less than 110°.

The terms "first side" and "second side" of the seat module generally refer to sides that are not attached to a backrest portion or a side portion. For side chairs, the first and second sides of the side seat module are generally opposite each other, are not attached to the backrest portion, and are substantially perpendicular to the side of the seat module that is attached to the backrest portion. For corner chairs, the first and second sides of the corner seat module are substantially perpendicular to each other, and are not attached to the backrest portion or the side portion.

For embodiments in which the seat module is in the form of an armchair seat module, it contains a seat portion, a backrest portion, and two side portions. The backrest portion and the two side portions each lie in a different plane that intersects with the top surface of the seat portion at the same or substantially the same angle. The backrest portion and the two side portions are joined together at an angle of 90° or greater and less than 180°, typically at an angle greater than 90° and less than 180°. The side portions each form an arm rest. The side portions can have any suitable shape and size to serve as an arm rest. Optionally, the height of each side portion is the same as the height of the backrest portion. Alternatively, the height of each side portion can be less than the height of the backrest portion. Optionally each of the side portions has one or more open regions between the seat portion and the top surface of the side portion.

The seat module can be formed from one or more parts, such as by attaching the seat portion to the backrest portion and optionally the side portion. However, optionally, the seat module is a single, unitary part, such as formed via rotational molding or 3D-printing.

a. Connecting Port

The bottom surface of the seat portion is configured to be connected to one or more leg modules, typically to two or more leg modules, via a connection system. The seat module can be attached to the leg modules via any suitable connection system that aligns and retains the leg modules in the desired orientation. The bottom surface of the seat portion can contain a connecting port configured to receive and attach to the connection system. The connecting port can include one or more depressed regions and/or one or more grooves.

FIG. 1C illustrates an exemplary connecting port 140 on the bottom surface 122 of the seat portion 112. The connecting port 140 includes a central depressed region 142 adjacent to an elevated region 144 and separated from the elevated region 144 via a side wall 148. Optionally, the connecting port 140 contains one or more grooved junctions 152*a*, 152*b*, 152*c* for securing the one or more leg modules to the seat module 100 and/or for attaching two different seat modules to each other. Optionally, the connecting port 140 contains one or more holes 162*a*, 162*b* configured to receive a fastener, such as a screw, bolt, nail, or other fastener that secures a leg module and/or an attachment bar to the bottom of the seat module.

b. Openings to Facilitate Drainage

The seat portion of each seat module typically contains one or more openings in the top surface and bottom surface of the seat portion that are configured to facilitate drainage and/or prevent water from gathering on the top surface of the seat portion, such as when the rain falls, and/or when moisture gathers on the seat, and/or when the seat is washed. In some embodiments, the top and/or bottom openings are in the form of a slot. Optionally the top opening is in the form of a slot that is configured to receive the bottom portion of a plug. The top opening and bottom opening are optionally connected to each other via a gutter configured to guide water from the top opening to the bottom opening. For hollow seat portions, a gutter or other guide is not required to direct the water from the top opening to the bottom opening. Optionally for hollow seat portions, the hollow region of the seat portion contains a bottom surface that slopes towards one or more of the bottom openings to facilitate drainage.

The top opening, such as a top slot or hole, is in the top surface of the seat portion and is in fluid communication with the bottom opening in the bottom surface of the seat portion. For hollow seat portions, the top opening and the bottom opening may be aligned with each other or not aligned with each other. Optionally the bottom surface contains more than one bottom opening to facilitate removal of the water from inside the seat portion. Optionally, the interior of the bottom surface of the hollow portion is configured to guide the water towards one of more of the bottom openings, such as by sloping towards the bottom opening.

Optionally the interior of the seat portion contains a gutter, which defines a path through which water can flow from the top opening, through the inside of the seat module and out the bottom opening. The gutter can be defined by two side walls and a hollow center, where the side walls extend from the inside of the top surface to the inside of the bottom surface. Optionally, the gutter is configured to guide water that enters the slot at the top surface, through the height of the seat portion, and out one or more bottom openings in the bottom surface of the seat portion.

i. Top Opening Configured to Align Cushions

The top opening can be in the form of a slot or a hole with a suitable size and shape to receive the bottom portion a plug, and permit water to flow through the slot when the bottom portion of the plug is inside the top opening of the seat portion. The top opening can have any suitable geometry that is configured to receive the bottom portion of the plug. Thus, the two dimensional shape of the top opening generally corresponds with the geometry of a cross-section of the bottom portion of the plug taken in a horizontal plane. For example, if the bottom portion of the plug is in the form a cylinder, such as a post or stick, then the top opening will be in the shape of a circle having a sufficient diameter to allow for the bottom portion to fit therein and be removable therefrom. Optionally the bottom portion fits snugly, e.g. with a friction fit, inside the top opening. Suitable geometries for the top opening include regular and irregular shapes. For example, suitable geometries for the top opening include, but are not limited to, circle, oval, square, rectangle, triangle, trapezoid, parallelogram, hexagon, heptagon, octagon, etc. The top opening can be located in any suitable location on the seat portion. Optionally, the seat portion contains two or more top slots. For example, the seat portion may contain a first top slot towards the front of the seat portion and a second top slot in the back of the seat portion. Having more than one top slot can facilitate attachment and alignment of long seat cushions, such as a seat cushion that has suitable dimensions to cover two or three seat modules.

Optionally the backrest portion of the seat module contains a back opening, optionally in the form of a slot, that is configured to receive the tab of a plug and thereby align and orient a back cushion in a desired location against the backrest portion.

A seat cushion can be placed on the top surface of the seat portion. The seat cushion optionally is held in place on the top surface of the seat portion for example, via a plug configured to fit in the slot, such as to prevent the seat cushion from sliding off the seat.

Similarly, for embodiments in which the backrest portion contains a slot, a back cushion can be aligned against the backrest portion and it can be retained in place by inserting the bottom portion of a plug in the back slot in the backrest portion, when the top of the plug is attached to one side of the back cushion.

Figure 1E:
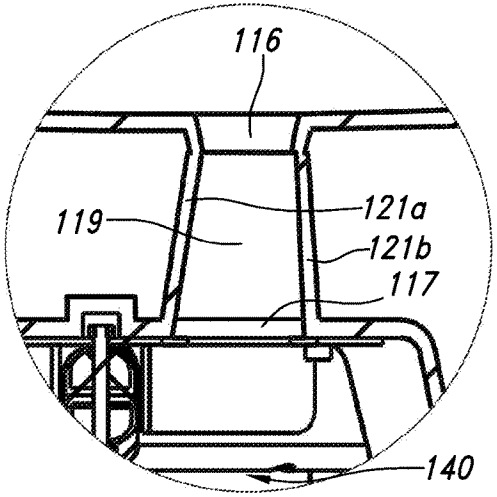
FIGS. 1D-1G are different views of an exemplary chair containing the seat module depicted in FIGS. 1A-1C.
Figure 1G:
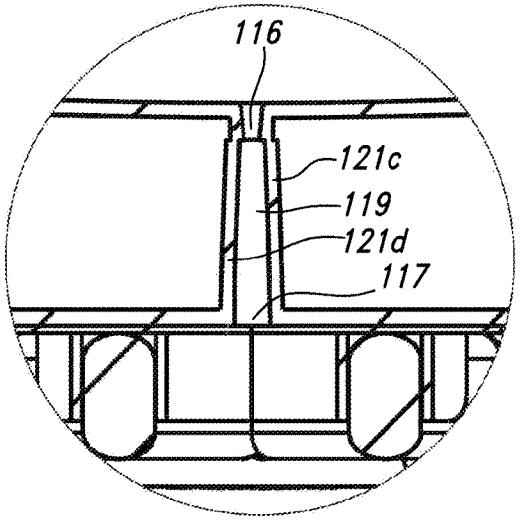
Figure 1D:
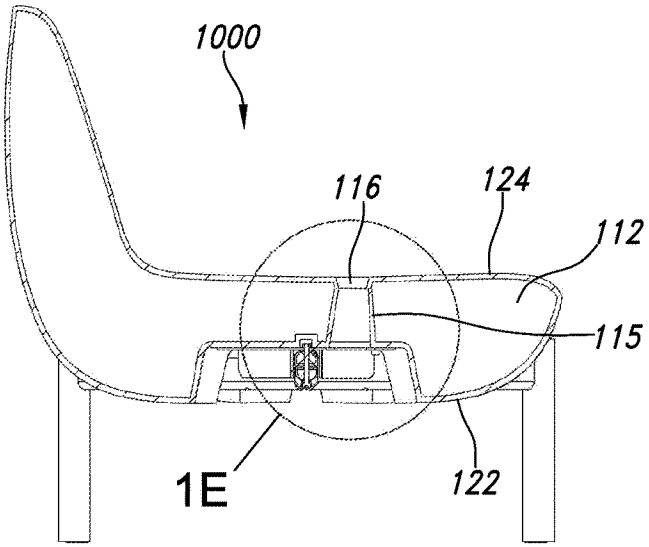
Figure 1F:
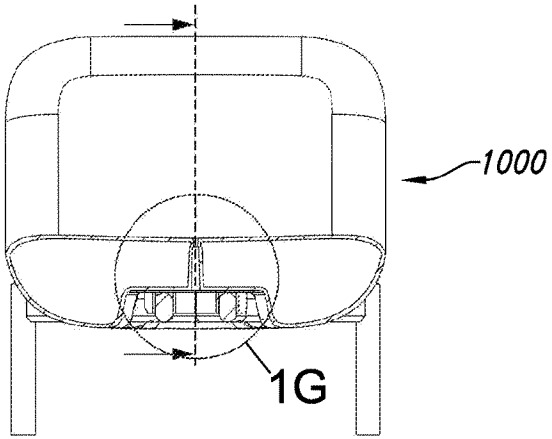
Figure 2B:
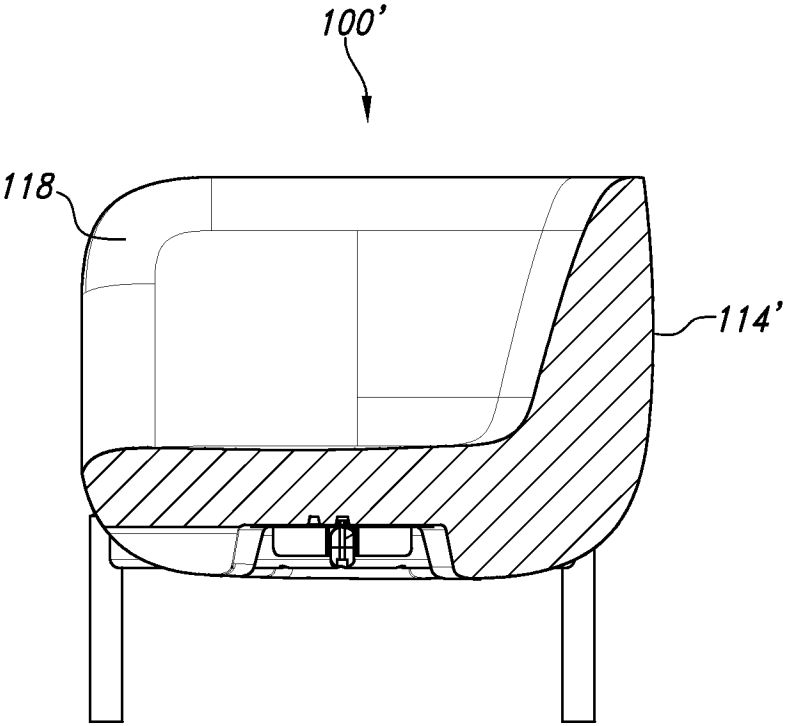
FIG. 2B is a cross-sectional view of an exemplary chair, which includes the exemplary seat module depicted in FIG. 2A.
Figure 2A:
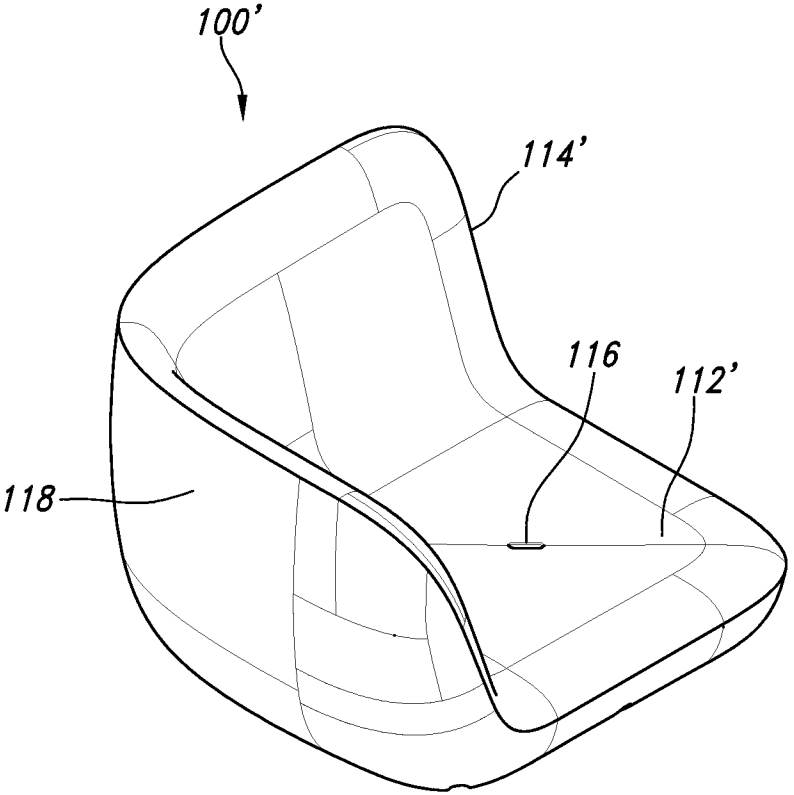
FIG. 2A is a perspective view of another exemplary seat module 100'.

Exemplary seat modules are depicted in FIGS. 1A-1E, 2A and 2B. For example, FIGS. 1A-1E illustrate a seat module 100 containing a backrest portion 114 and a seat portion 112 connected to each other at an angle of greater than 90° and less than 180°. FIGS. 2A and 2B illustrate the elements of an exemplary corner seat module 100', containing a backrest portion 114', seat portion 112', and a side portion 118, where the backrest portion 114' and the side portion 118 each intersect with the seat portion 112' at the same or substantially the same angle, and the backrest portion 114' and the side portion 118 are joined together at an angle of 90° or greater and less than 180°, typically at an angle greater than 90° and less than 180°, such as greater than 90° and less than 170°, greater than 90° and less than 160°, greater than 90° and less than 150°, greater than 90° and less than 140°, greater than 90° and less than 130°, greater than 90° and less than 120°, or greater than 90° and less than 110°.

As shown in FIG. 1D, the seat portion 112 has a top surface 124 and a bottom surface 122. The seat portion 112 typically includes at least one top opening, such as in the form of a top slot 116, in the top surface 124, where the top slot is configured to permit water drainage. For example, as shown in FIGS. 1E and 1G, the top slot 116 is attached to and in fluid communication with a gutter 115, which runs through the height of the seat portion 112 and is in fluid communication at its opposite end with a bottom opening 117 in the bottom surface 122 of the seat portion 112. Optionally, gutter 115 is formed of one or more side walls 121*a* and 121*b* separated by an open region 119. The top slot 116 is configured to receive a tab of a plug. The bottom opening can have any suitable size and shape to allow egress of the water that flows through the seat portion. Optionally, the bottom opening is in the form of a slot.

Figure 10B:
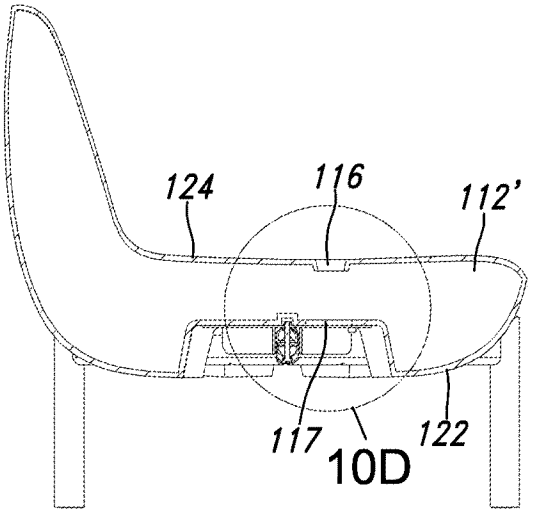
FIGS. 10A-10D illustrate an exemplary side chair having a modified drainage system.
Figure 10D:
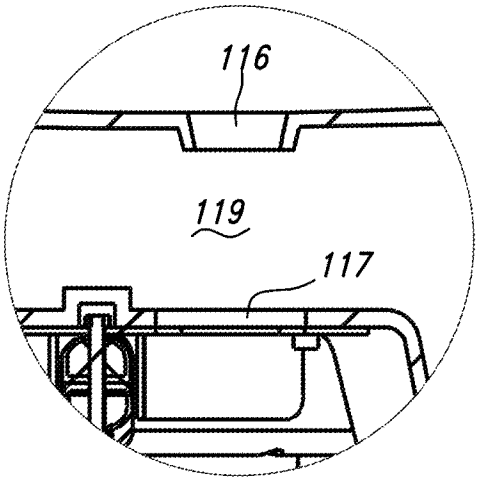
Figure 10A:
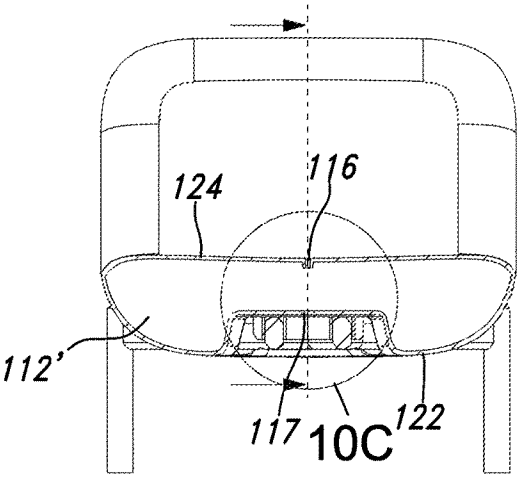
Figure 10C:
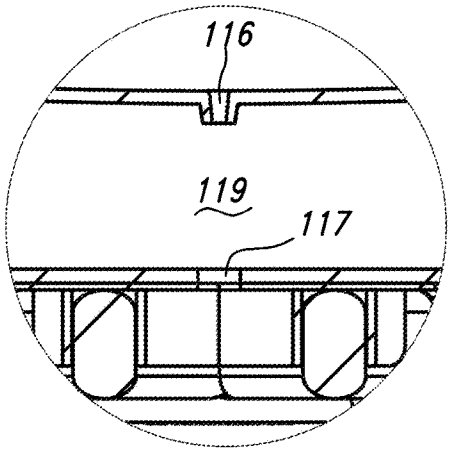
Figure 11B:
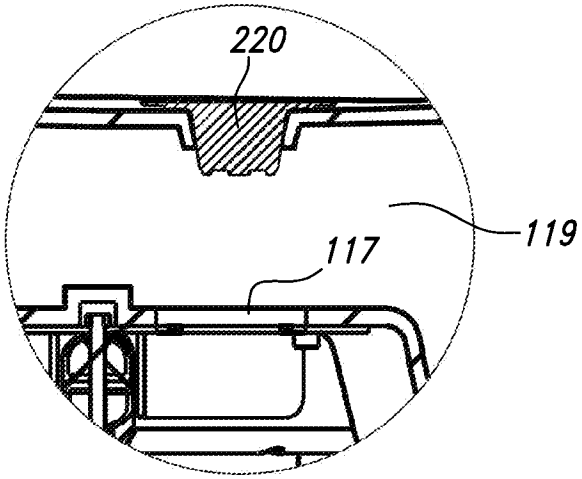
FIGS. 11A-11B are different views of an exemplary side chair having a modified drainage system with a plug attached.
Figure 11A:
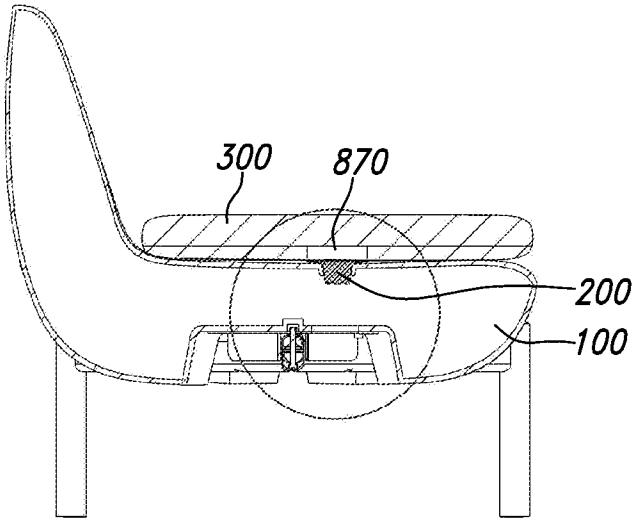

In some embodiments, the inside of the seat portion does not contain a gutter, such as when the seat module is substantially hollow and/or contains hollow seat portion. In these embodiments, the drainage system contains at least one top slot and one or more bottom openings. Optionally, the angle of a portion of the inside bottom surface of the seat portion is configured to guide the water toward the bottom opening(s). Optionally, the bottom surface contains more than one bottom opening, such as two or more, or three or more bottom openings. For example, as shown in FIGS. 10A-10D, the seat portion 112' includes a top slot 116 in the top surface 124 and a bottom opening 117, in the form of a slot, in the bottom surface 122. As shown in FIGS. 10C and 10D, the bottom opening 117 in the bottom surface 122 is aligned with the top slot 116 to facilitate water egress. An open region 119 is located between the top slot 116 and the bottom opening 117, which allows the water to flow from the top slot, through the inside of the seat portion and out the bottom opening(s). Alternatively, the bottom opening can be located to the right or the left or off-center relative to the top slot and still permit water egress. The top slot 116 in the top surface 124 is configured to receive a tab of a plug.

When a seat cushion in placed on top of the seat portion of a chair, ottoman, or other seating unit, the plug fits inside the top opening in the seat portion, to retain the seat cushion in place while allowing moisture to drain out of the seat portion of the chair. As shown in 11A and 11B, the tab 220 of the plug 200 fits in the top opening, such as the slot 116, of the seat module 100. The top portion 210 of the plug lies on top of the seat portion and is attached to the seat cushion 300, while the bottom portion 220 of the plug 200 fits inside the slot 116. As shown in FIGS. 3E, 3F, 3H, 3I, and 11B, when water gathers on the top surface 124 of the seat portion 112, it is able to flow into the slot 116 and along the channels 230*a*, 230*b* of the bottom side 218 and tab portion 220 of the plug 200, though the hollow region 119 of the hollow seat portion 100 and exit through the bottom opening 117 in the bottom surface of the seat module.

B. Plug

The furniture typically includes an attachment and drainage device, such as a plug that is configured to attach a cushion to the top surface of the furniture and also facilitate drainage and/or prevent water from gathering on the top surface of the seat portion, such as when the rain falls, when moisture gathers on the seat, and/or when the seat is washed. The plug typically contains two parts, a top portion and a bottom portion, where the bottom portion protrudes from the top portion, and optionally is aligned substantially perpendicular to the top portion of the plug. The bottom portion can have any suitable shape and dimensions as long as it fits inside the top opening (and/or the backrest portion opening) and is removable therefrom by manually pulling the seat cushion and/or the plug out of the opening. Optionally the bottom portion fits snugly, e.g. with a friction fit, inside the opening in the seat module. In some instances, the bottom portion of the plug is in the form of a tab that is configured to fit in the opening of the seat module and is removable therefrom.

The top portion of the plug contains a top side and a bottom side. The top side is substantially flat. The top portion can have any suitable geometry, for example, the top view of the top portion may be in any two-dimensional shape, such as a circle, oval, rectangle, star, heart, flower, etc. The shape of the top portion can be symmetrical or asymmetrical. Optionally, the shape is a symmetrical shape, optionally the shape is a circle.

The top side of the top portion of the plug generally contains or is adhered to a fastening mechanism, such as a hook and loop fastener (e.g., Velcro® material) for connecting the plug to the bottom side of the seat cushion. Optionally, the fastening mechanism is adhered to the top side by glue or a similar adhesive to maintain the attachment of the fastening mechanism to the top portion of the plug. Optionally, the fastening mechanism is adhered to the top side via heat welding to maintain the attachment of the fastening mechanism to the top portion of the plug. In some instances, the top side contains an adhesive layer that is attached to the fastening mechanism.

The dimensions of the top portion of the plug are typically smaller than the dimensions of the cushion. Optionally, the top portion of the plug has a diameter or largest dimension (i.e. width or length) of about 50 mm-100 mm, such as about 50-90 mm, or about 60-80 mm. However the top portion of the plug can have larger dimensions, such as greater than 100 mm until about 250 mm or up to about 500 mm, or smaller dimensions, such as smaller than about 80 mm, smaller than about 50 mm, such as in the range of about 20 mm to about 80 mm, about 20 mm to about 60 mm, about 20 mm to about 50 mm, about 30 mm to about 80 mm, about 30 mm to about 70 mm, or about 30 mm to about 60 mm.

The bottom side of the top portion of the plug optionally includes a substantially flat region that forms the perimeter of the bottom side and two or more elevated regions. The elevated regions are separated from each other by the substantially flat regions forming one or more channels to facilitate water flow. The one or more elevated regions terminate in any suitable edge; optionally the one or more elevated regions terminate in a beveled or rounded edge, a square edge, or a mitered edge, etc.

The bottom portion of the plug has any suitable configuration that fits in the top slot of the seat module and facilitates drainage and/or prevents water from gathering on the top surface of the seat portion. The bottom portion of the plug has suitable dimensions to be placed in the top opening and manually removed therefore, such as by manually pushing into and manually pulling out of the top opening in the seat module. Optionally the bottom portion has a size and shape that is configured to fit snugly, e.g. with a friction fit, inside the opening, such as the top opening or an opening in the backrest portion.

The bottom portion of the plug can have any suitable geometry that is configured to fit in the corresponding opening, such as a top opening or a backrest opening, in the seat module. Thus, the geometry of a cross-section of the bottom portion of the plug taken in a horizontal plane generally corresponds with the shape of the opening. For example, the bottom portion of the plug can be in the form of a cylinder, such as a post or stick. Suitable geometries for the cross-section of the bottom portion of the plug taken at a horizontal plane include, but are not limited to circle, ellipse, obround, pill-shaped, square, rectangle, triangle, trapezoid, parallelogram, hexagon, heptagon, octagon, etc., optionally with one or more indents or channels to facilitate water flow along its perimeter. In some instances, the bottom portion of the plug is in the form of a tab, where the tab can have any suitable geometry to fit inside the opening and facilitate water flow therethrough.

Typically, when the bottom portion is in the form of a tab, it contains two sides: a first side and a second side. Optionally, the first side and second side have identical configurations. Optionally, one side has a different configuration than the other side. For example, optionally one side is substantially flat, and the other side has one or more channels to facilitate the flow of water. When the first side and second side have identical configurations, optionally both sides contain at least one defined channel to facilitate the flow of water. Optionally, the first side and/or second side contain two channels, three channels, four channels, five channels or more channels to facilitate drainage through the slot when the tab of the plug is in the slot. Optionally, the first side and/or second side do not contain any channels or indentations to facilitate flow.

Optionally, each of the one or more channels includes a depressed region adjacent to two or more elevated regions or ridges. The elevated regions or ridges are generally positioned in the bottom portion to connect to the depressed region by a wall, thereby forming the channel. Optionally, the elevated regions or ridges are connected to the depressed region to form a rectangular, V-shaped or trapezoidal channel. Optionally, the elevated regions or ridges are straight, jagged, irregular, or uneven. Optionally, the depressed region is flat or curved.

The depressed region and the ridges of the one or more channels can be aligned with the substantially flat region and the elevated regions of the bottom side of the top portion to form a continuous channel and thereby facilitate water flow.

The bottom portion of the plug can have any suitable shape and dimensions that fits inside the slot and is removable therefrom. Typically, the bottom portion has a length that is shorter than or equal to the length of the slot. Optionally, the bottom portion of the plug has a length of about 50 mm or less, such as about 30-50 mm, about 10-50 mm, about 20-50 mm, about 10-45 mm, about 20-45 mm, about 30-45 mm, or about 40-45 mm. The width of the bottom portion of the plug is smaller than the width of the slot. Optionally, the bottom portion of the plug has a width of about 5 mm or less, such as about 1-5 mm, about 2-5 mm, about 2-4 mm, about 3-4 mm, about 3-5 mm, about 4-5 mm, or about 4-4.5 mm.

The plug can be formed from one or more parts, such as by attaching the top portion to the bottom portion. However, optionally, the plug is a single, unitary part, such as formed via injection molding or 3D printing.

Suitable materials for forming the plug include but are not limited to silicone, rubber, polyethylene, polypropylene, and thermoplastic elastomer.

An exemplary plug is illustrated in FIGS. 3A-3I. As shown in FIGS. 3A-3D, the plug 200 contains two parts, a top portion 210 and a bottom portion 220 that is aligned substantially perpendicular to the top portion of the plug. The bottom portion 220 is in the form of a tab and is configured to fit in the slot 116 of the seat module 100. The top portion 210 contains a top side 216 and a bottom side 218. The top side 216 is substantially flat. The top portion 210 has a symmetrical two-dimensional shape, such as a circular shape. The top side 216 of the top portion 210 contains or is adhered to a fastening mechanism, such as a hook and loop fastener (e.g., Velcro® material) for connecting the plug to the bottom side of the cushion. Optionally, the fastening mechanism is adhered to the top side 216 by glue or a similar adhesive to maintain the attachment of the fastening mechanism to the top portion of the plug.

Figure 3C:
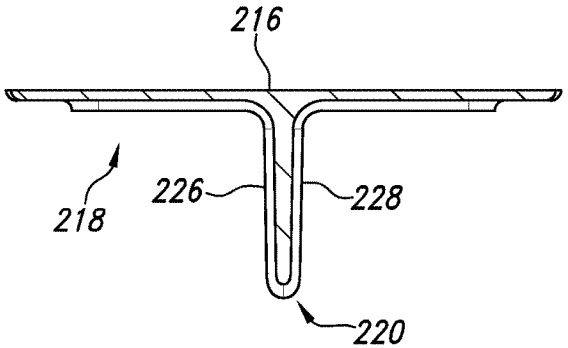
FIGS. 3A-3F are different views of an exemplary plug.
Figure 3B:
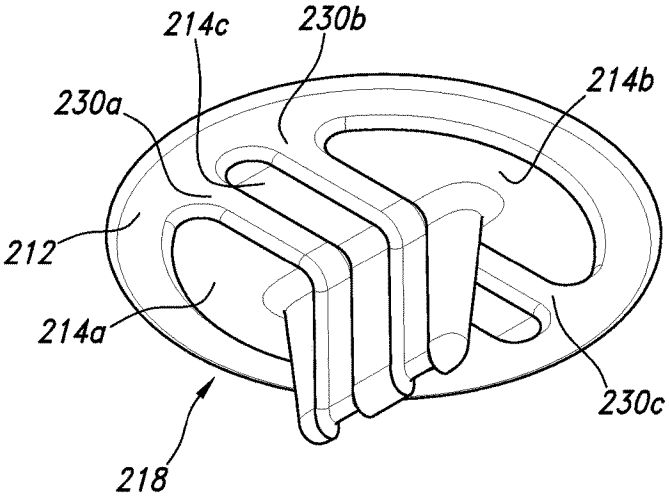
Figure 3A:
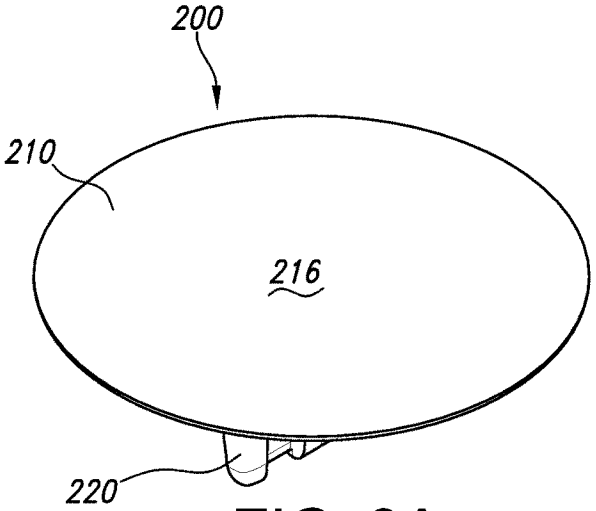

As shown in FIG. 3B, the bottom side 218 of the top portion 210 can include a substantially flat region 212 that forms the perimeter of the bottom side 218 and at least two outer elevated regions 214*a*, 214*b*. The outer elevated regions 214*a*, 214*b* are separated from each other by the substantially flat regions forming four channels, where two channels 230*a*, 230*b* are located on each side of the top and bottom portions. As depicted in FIG. 3B, the two elevated regions 214*a*, 214*b* connect with corresponding elevated regions in the bottom portion 224*a*, 224*b*. To form two channels on each side of the plug, the top portion can contain a third, inner elevated region 214*c*, located between the two outer elevated regions, 214*a*, 214*b*. The inner elevated region 214*c* similarly connects with a corresponding elevated region 224*c* in the bottom portion.

Figure 3F:
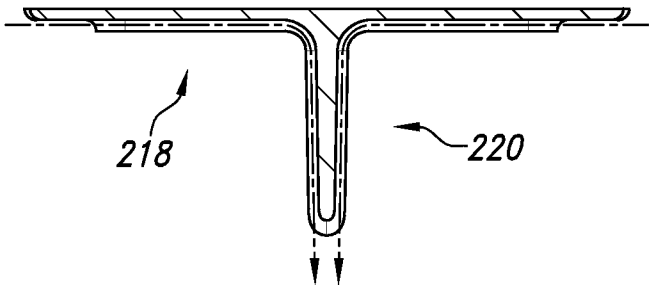
Figure 3D:
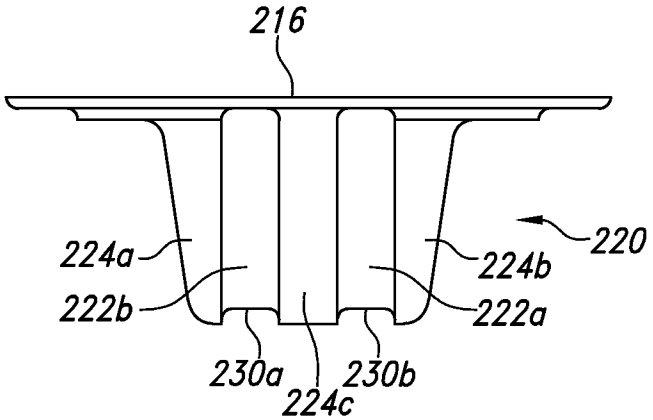

As shown in FIG. 3D-3I, the bottom portion 220 is in the form of a tab and is configured to fit in the slot 116 of the seat module 100. As shown in FIGS. 3C and 3D, the bottom portion 220 contains a first side 228 and a second side 226. The first side 228 and second side 226 are shown as having identical configurations. However, optionally, only one of the first or the second side contains channels or each side can contain the same number of channels or a different number of channels, and/or the channels can have different configurations.

Figure 3E:
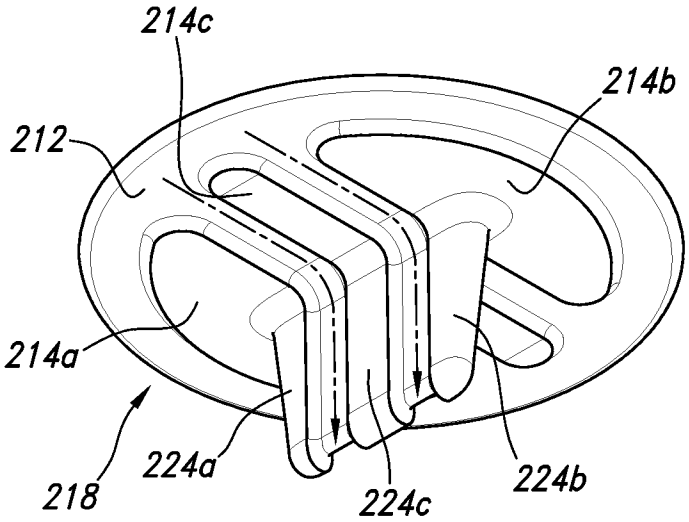
Figure 3I:
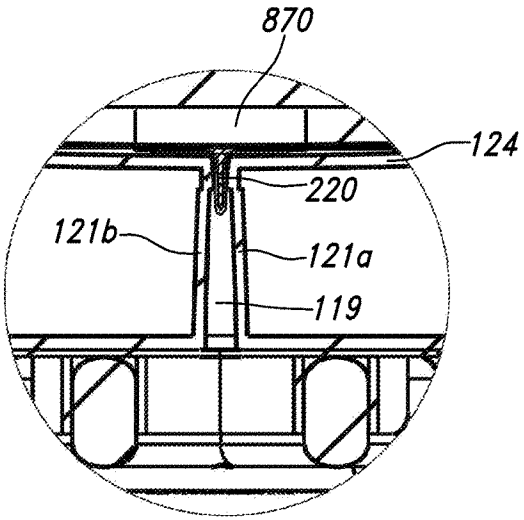
FIGS. 3H and 3I are enlarged side and front views, respectively, of the region denoted with a circle in FIG. 3G, showing the alignment of the top portion 210 and bottom portion 220 of the plug, in relation to the cushion 300 and gutter 115 in the seat module.
Figure 3H:
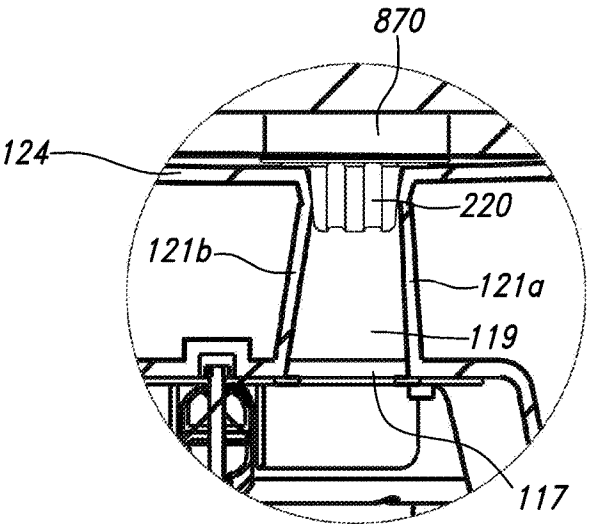
Figure 3G:
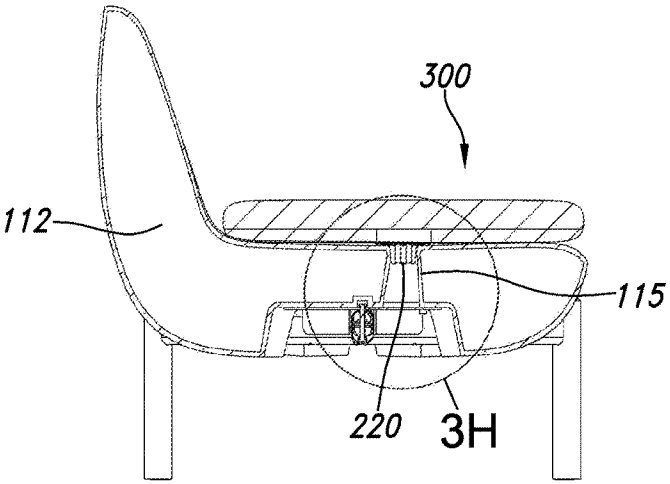
FIG. 3G is a cross sectional view of an exemplary chair containing a removable seat cushion.

As shown in the figures, each of the first side 228 and second side 226 can contain two channels 230*a*, 230*b* to facilitate water drainage through the slot when the tab of the plug 200 is in the slot 116. Each of the two channels 230*a*, 230*b* has a depressed region 222*a*, 222*b*, enclosed by three elevated regions or ridges 224*a*, 224*b*, 224*c*. The elevated regions or ridges 224*a*, 224*b*, 224*c* are positioned in the bottom portion 220 to connect to the depressed region 222*a*, 222*b*, by a wall, thereby forming the channel 230*a*, 230*b*. The elevated regions or ridges 224*a*, 224*b*, 224*c* are connected to the depressed regions 222*a*, 222*b*, optionally in a manner that forms a substantially trapezoid-shaped channel. As shown in FIGS. 3D and 3E, the depressed region 222*a*, 222*b* and the ridges 224*a*, 224*b*, 224*c* of the two channels 230*a*, 230*b* are aligned continuously with the substantially flat region 212 and the elevated regions 214*a*, 214*b*, 214*c* of the bottom side 218 of the top portion 210 to facilitate continuous water flow. FIG. 3E and FIG. 3F illustrate the flow of water through an exemplary plug 200 containing two channels.

As shown in FIGS. 3G-3I, 11A, and 11B, the tab 220 of the plug 200 fits in the slot 116 of the seat module 100. The top portion 210 of the plug lies on top of the seat portion and is attached to the seat cushion 300, while the bottom portion 220 of the plug 200 fits inside the top opening, such as a slot 116. The bottom portion is located in the slot in a manner that allows for its easy removal, as desired, or in the case of a storm, when the force of the storm can push the cushion upward and thereby remove the bottom portion from the slot. In embodiments where a gutter is attached to the slot, the gutter attached may be substantially longer than the length of the bottom portion of the plug (see, e.g. FIGS. 3H and 3I). Thus, when a gutter is in the interior of the seat module and in fluid communication with the slot, the bottom portion is typically located in the slot and does not extend through a significant portion of the gutter, leaving the gutter 115 substantially open and hollow to facilitate the flow of water therethrough (see, e.g. FIGS. 3H and 3I). As shown in FIGS. 3E, 3F, 3H, 3I, and 11D when water gathers on the top surface 124 of the seat portion 112, it is able to flow into the slot 116 and along the channels 230*a*, 230*b* of the bottom side 218 and tab portion 220 of the plug 200 and exit through the opening 117 in the bottom surface of the seat module.

C. Seat Cushion

One or more seat cushions are configured to be aligned on top of and prevented from slipping off of the seat portion via a removable plug. The seat cushion can attach to the plug via any suitable attachment means. Preferably, the seat cushion is attached to the plug in a manner that allows the use of manual force to separate the plug from the seat cushion without damaging either the seat cushion or the plug. The seat cushion is of any suitable shape and size to fit on top of the seat portion.

Optionally, the seat cushion has the cross-section of a square having a length and a width in the range of about 400 mm to about 600 mm, such as from about 450 mm to about 550 mm, such as from about 500 mm to about 550 mm, from about 510 mm to about 520 mm, or about 515 mm. Optionally, the seat cushion has the cross-section of a rectangle having a width in the range of about 400 mm to about 600 mm, such as from about 450 mm to about 550 mm, from about 500 mm to about 550 mm, from about 510 mm to about 520 mm, or about 515 mm, and a length in the range of about 400 mm to about 700 mm, such as from about 450 mm to about 700 mm, from about 500 mm to about 700 mm, from about 600 mm to about 700 mm, from about 600 mm to about 650 mm, from about 600 mm to about 640 mm, from about 610 mm to about 650 mm, from about 620 mm to about 650 mm, or from about 630 mm to about 650 mm, or from about 640 mm to about 645 mm Optionally, the length of the cushion is longer, such as the equivalent length of the assembly of two, three, or four seats. For example the length of the cushion can be in the range of about 1 m to about 2 m, about 1 m to about 1.1 m, about 1 m to about 1.2 m, about 1 m to about 1.3 m, about 1 m to about 1.4 m, about 1 m to about 1.5 m, about 1 m to about 1.6 m, about 1 m to about 1.7 m, about 1 m to about 1.8 m, or about 1 m to about 1.9 m.

Figure 4B:
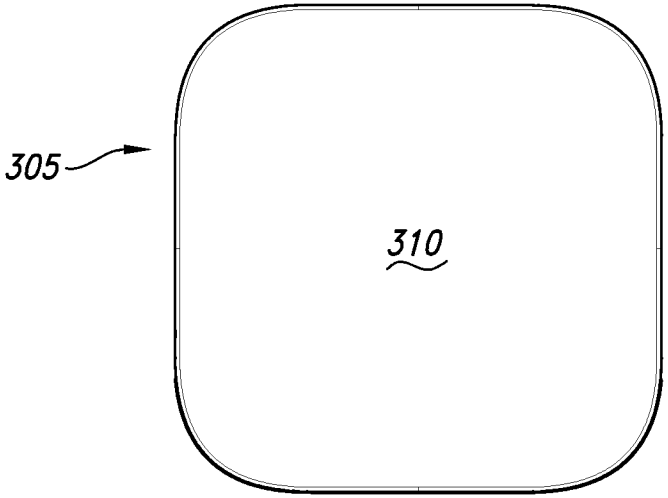
FIGS. 4A-4E are different views of an exemplary seat cushion.
Figure 4C:
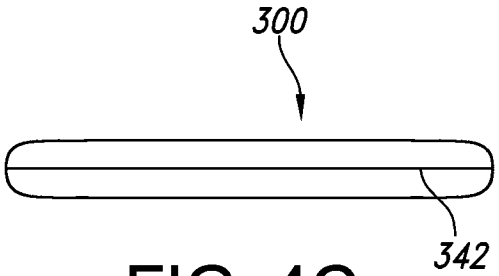

The seat cushion can have a regular or irregular shape. For example, FIGS. 4F and 4G show an exemplary seat cushion 300, which is rectangular in shape, and is located on top of the top surface 124 of the seat portion 100.

In some embodiments, the seat cushion contains a cushion cover formed of a front portion and a back portion, and contains an inner cushion inside the cushion cover. Optionally the cushion cover is removable from the inner cushion. Optionally, the cushion cover is not removable. In some embodiments, the seat cushion contains one or more cushion materials and does not contain a removeable cover. For example, the outer surfaces of the cushion materials can be coated with an outer coating to prevent or reduce the absorption of moisture by the cushion.

1. Cushion Cover

The seat cushion optionally contains a cushion cover which has a suitable dimensions and shape to enclose the inner cushion inside the cover. The cushion cover is generally formed of a front portion and a back portion that are connected to each other and form an enclosure or a pouch configured to contain the inner cushion. Generally, the front portion and the back portion are connected to each other along a common border, such as a seam, to form the cushion cover.

The cushion cover can have any suitable shape and size that fits on the top surface of the seat portion. For example, the cushion cover can have a regular or irregular shape. Optionally, the cushion cover is a rectangle, circle, oval, square, hexagon, heptagon, octagon, or any suitable shape that fits on the seat portion of the seat module. For example, as shown in FIG. 4B, the cushion cover 305 can be in the shape of a rectangle. The front portion 310 and back portion 320 of the cushion cover are optionally attached to each other along a common border or edge 342.

Optionally, the front and/or back portion are formed from a single material. Optionally, the front and/or back portion are each formed from a single material or two or more materials, which are attached to each other, such as via an adhesive or sewn together. In this embodiment, the front and the back portions are sewn or otherwise adhered together, such as via heat or ultrasonic welding, along a common border, or one or more of the regions of the common border. Optionally, the front and/or back portion are each formed from two or more materials, which are attached to each other, such as by sewing or via heat or ultrasonic welding. Optionally, the front portion and the back portion are connected along one or more of the regions and/or sides of the common border via any suitable connection means such as but not limited to zippers, magnets, buttons, snaps, adhesive, tape, loop, clips, or Velcro® (hook or loop fastener).

In some embodiments, the back portion contains an opening that allows for the inner cushion to be inserted into the cushion cover and removed therefrom. This allows the inner cushion to be inserted into and removed from the cushion cover, as needed, such as to facilitate cleaning of the cushion or replacement of the inner cushion or the cushion cover. The opening can include a zipper, magnets, buttons, snaps, adhesive, tape, loop, clips, or Velcro® (hook or loop fastener) or other means to open and close the opening. The opening can be created in a single material of the back portion, such as in the form of a slit. Alternatively, the back portion can be formed from two or more materials, where the opening is located between the two materials. The two or more materials can be the same or different.

In some embodiments, the back portion contains a first material and a second material, where most of the edges of the second material and the first material are attached to the front portion and either their top or bottom edge, and the top or bottom edge of each of the first and second materials is not attached to the top portion. The unattached edges of each of the first and second materials form the opening. Optionally, the bottom edge of the second material lies over the top edge of the first material, and top edge of the first material lies under part of the second material to form the opening. Optionally, a clasp or other fastener is located between the first and second materials and is configured to open and close the opening. Optionally, the opening between second material and the first material can be closed via a hidden zipper or other fastener. Optionally, the second material lies over the zipper or fastener, creating a 'hidden' zipper or fastener (see, e.g. FIGS. 4A and 4J).

In other embodiments, the front portion and the back portion contain an opening along at least a portion of the common border. This opening along the common border or edge is sufficiently large to permit insertion of the inner cushion into and removal of the inner cushion from the cushion cover.

The back portion is optionally formed of and/or coated with a material that provides a friction or resistance element to prevent or reduce sliding of the cushion when it is on top of the seat module. Optionally, a non-slip material is attached to the back portion to prevent sliding of the seat cushion when it is on the seat module. The non-slip material can comprise a non-slip patch, non-skid pad, and/or gripper liners/pad. Suitable materials to be attached to or coated on the back portion to increase resistance between the cushion cover and the seat portion include but are not limited to polyester woven fabric with non-slip PVC or silicone coatings.

The back portion contains one or more attachment regions which are configured to be attachable to and removable from the fastening mechanism on the top portion of the plug. The one or more attachment regions can attach to and be removed from the fastening mechanism via any suitable fastener mechanism, such as magnet, mechanical clip, button, snap, adhesive, tape, loop, clip, or Velcro® (hook or loop fastener) attachment interface, although a hook and loop attachment interface, mechanical clip or magnets are the preferred attachment interfaces.

The attachment region can have the same dimensions as the cross-section of the top portion of the plug or different dimensions. The attachment region is typically at least as long and as wide as the cross-section of the top portion of the plug.

Figure 4A:
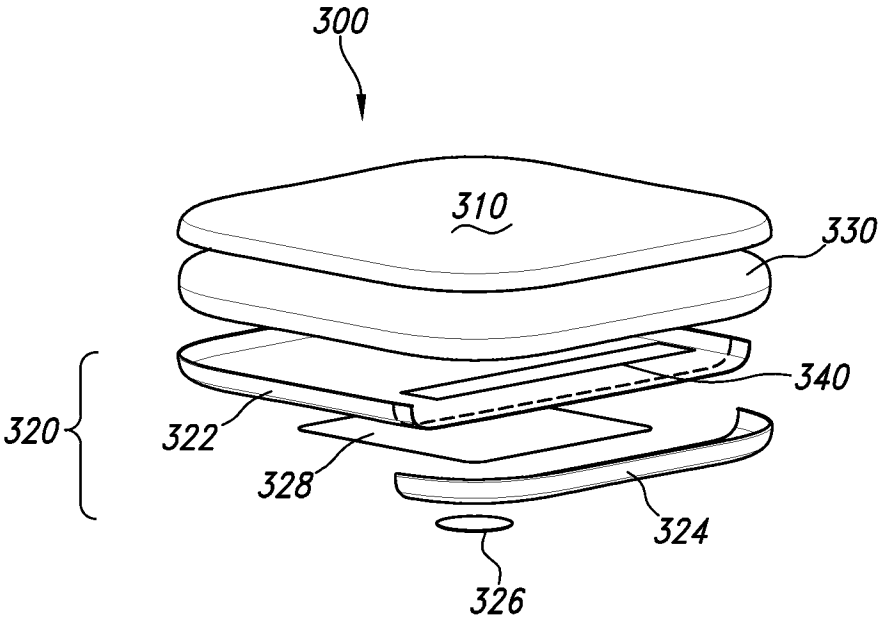
Figure 4E:
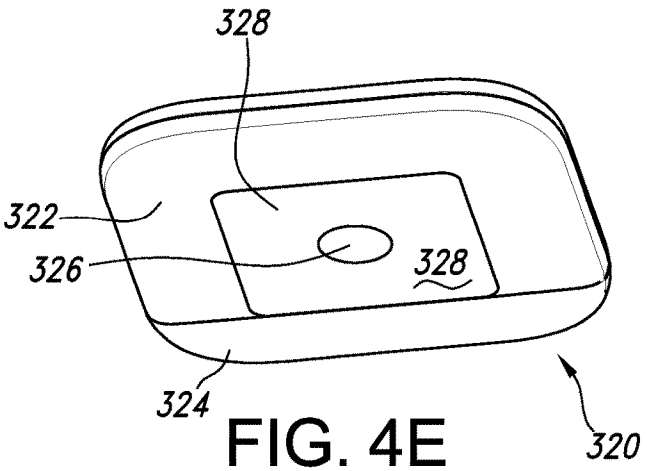
Figure 4K:
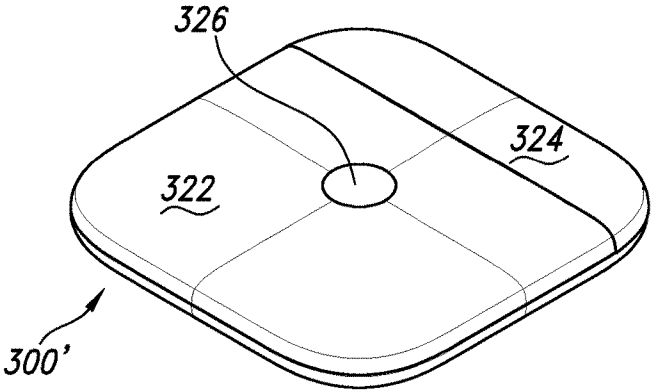
FIG. 4K is a bottom perspective view of a modified seat cushion without a non-slip patch.
Figure 4D:
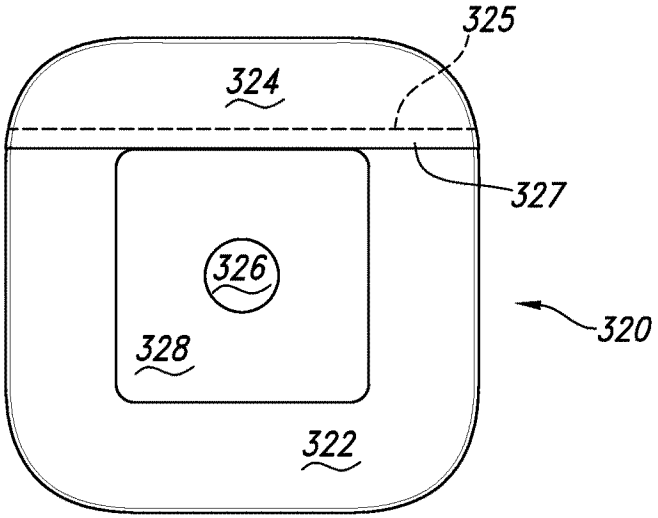
Figure 4J:
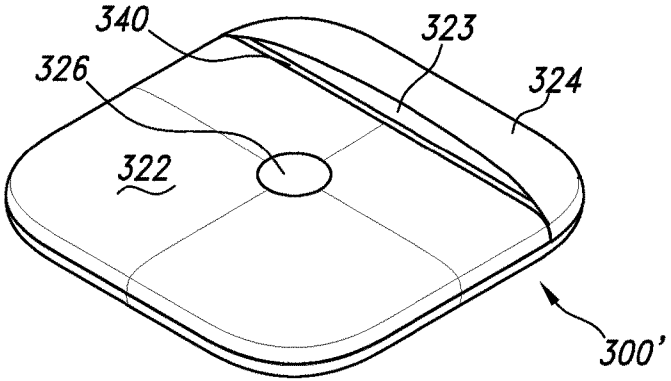
FIG. 4J is a bottom perspective view of a modified seat cushion without an inner cushion and without a non-slip patch.
Figure 4G:
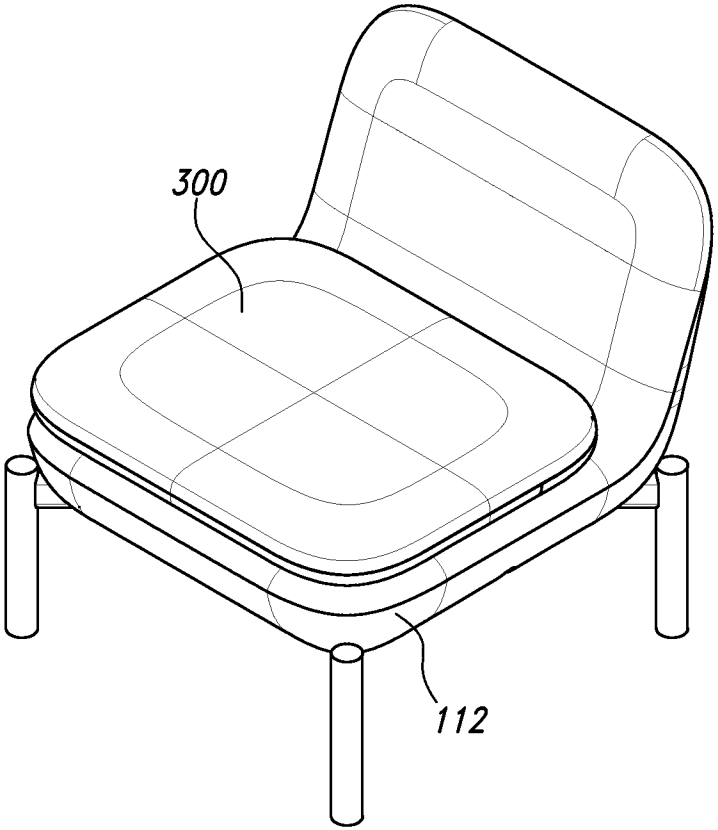
FIGS. 4F and 4G are a side view and perspective view, respectively, showing an exemplary seat cushion 300 located on the top surface of the seat portion 100.
Figure 4F:
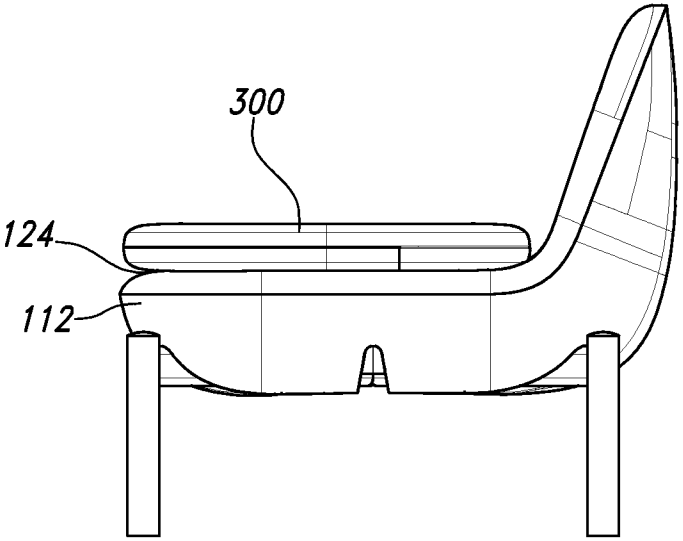
Figure 4I:
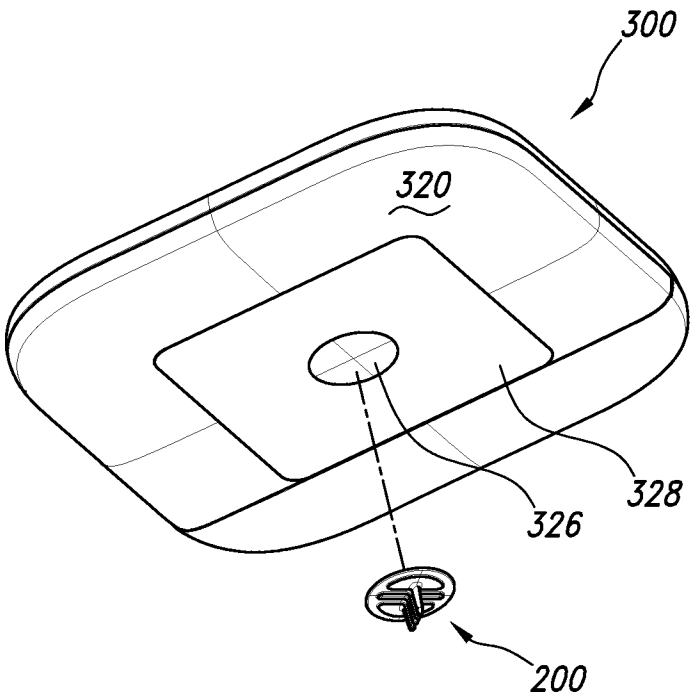
FIGS. 4H and 4I are bottom views of an exemplary seat cushion 300 with the plug 200 attached to and the plug separated from, respectively, the attachment region 326 of the back portion 320.

For example, as shown in FIGS. 4A-4K, the cushion 300 contains a cushion cover 305 and an inner cushion 330. The cushion cover 305 is formed from a front portion 310 and a back portion 320. Optionally, the inner cushion 330 is removable from the cushion cover 305, such as to facilitate cleaning. The cushion cover optionally contains an opening configured to insert and remove the inner cushion from the cover; the opening is typically located along a scam or in the back portion. For example, as shown in FIG. 4D, the cushion cover contains an opening in the back portion 320. Optionally, the back portion is formed from two materials, where the first material 322 lies under an edge of the second material 324 forming an opening 323 between the edges of the two materials. Optionally, the opening 323 between the first 322 and second 324 materials is configured to be opened or closed. Optionally, the opening 323 between the first material 322 and second material 324 can be opened and closed using a fastener or other means, such as a zipper. The opening 323 can be opened or closed using fasteners such as but not limited to magnets, buttons, snaps, zippers, adhesive, tape, loop, clips, or Velcro® (hook or loop fastener) or other means to open and close the opening.

As shown in FIGS. 4D and 4J, three of the edges of the second material 324 and the first material 322 are attached to the front portion 310, while the top edge 325 of the first material 322 and the bottom edge 327 of the second material 324 material are not attached and form the opening. The bottom edge 327 of the second material 324 can cover the top edge 325 and, optionally also the upper portion, of the first material 322. The separation between the first and second materials creates an opening 323 that is configured to allow the inner cushion 330 to be inserted into and removed through the opening 323 in the seat cushion cover. A fastener, such as a Velcro strip, zipper, or clasp, 340 can be located between the first and second materials, allowing the opening to be closed and opened, as desired. As shown in FIG. 4A, the exemplary seat cushion 300 has a zipper 340 positioned between the first material 322 and second material 324 of the back portion 320.

Figure 4H:
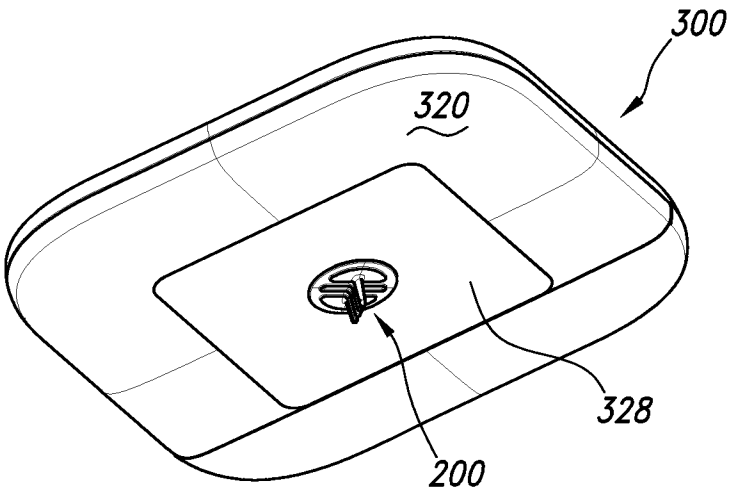

The exemplary seat cushion optionally contains a non-slip material, such as a patch 328, sewn or otherwise adhered to the first material 322 of the back portion 320. The non-slip patch 328 provides a friction or resistance element to prevent sliding of the cushion when it is on the seat module. FIGS. 4H and 41 illustrate an exemplary seat cushion 300 with and without the plug 200 attached, respectively, to the attachment region 326 of the back portion 320. The fastening mechanism on the top portion of the plug 200 is attachable to and releasable from the attachment region 326 via a hook and loop attachment interface. Although FIG. 4A is shown with the non-slip patch 328 attached to the back portion, the seat cushion does not require a non-slip patch or coating. For example, as shown in FIGS. 4J and 4K, the seat cushion 300' does not contain a non-slip patch or coating. The attachment region 326 is attached directly to a material in the back portion 320 of the seat cushion 300'.

Optionally, the plug is attached to the back portion of the cushion cover. For example, the top portion of the plug can be affixed, such as via glue or a similar adhesive, or sewn to attach the top portion of the plug to the cushion cover. In this embodiment, when the cushion is exposed to a storm, wind can blow against the cushion at a suitable force and at a suitable angle to remove the cushion, and the plug attached thereto, from the top surface of the seat portion. However, the top portion of the plug would typically remain attached to the back portion of the cushion.

a. Cushion Cover Material

The cushion cover can be formed from any suitable material. While the same material can be used on both portions of the cushion cover, optionally two or more materials are used. Preferably, the cushion cover material is a durable outdoor upholstery fabric. Preferably, the cushion cover material is water-repellent, mold/mildew-resistant, color fast, UV resistant, and/or washable. Suitable cushion cover materials include, but are not limited to polyester, solution-dyed acrylic, solution-dyed olefin. Exemplary brands of suitable cover materials include but are not limited to Sunbrella® Upholstery, Bella-Dura®, P. Kaufmann Outdoor Performance and Richloom Fortress®.

2. Cushion/Inner Cushion

The cushion or inner cushion 330 can be formed from any suitable material to provide a cushion having the desired softness and stability. Preferred cushion materials dry quickly. Optionally, the inner cushion is nonabsorbent, UV-resistant, mildew-resistant, nonallergenic, and/or antimicrobial material. Suitable materials include but are not limited to high-density polyurethane foam, medium-density, polyurethane foam, open-cell foam, or closed cell foam, Dry Fast foams polyester batting, polyfill, woven or nonwoven synthetic fabrics. For a medium stiffness foam, the foam typically has a density in the range of 1.4-1.8 pounds per cubic foot and, optionally, a foam IFD (Indentation Force Deflection) in the range of about 40-55 pounds, optionally about 45-55 pounds. For a stiff form, the foam typically has a density in the range of 1.8-2.8 pounds per cubic foot and, optionally, a foam IFD in the range of 60-80 pounds. For a soft foam, the foam can have a density in the range of 1.2-1.4 pounds per cubic foot and, optionally, a foam IFD in the range of 30-40, optionally 33-35 pounds. Optionally, the inner cushion is formed from one type of foam material. Optionally, the inner cushion is formed from two or more foam materials. The different cushion materials can be affixed to each other using a suitable adhesive, such as a spray adhesive. For example, the inner cushion contains two or more layers of polyester fiber of various densities.

In some embodiments, the inner cushion is formed from one or more cushion materials and is encased in a cushion cover, optionally a removable cushion cover. In other embodiments, one or more cushion materials form a stand-alone cushion that does not require a separate cushion cover.

In some embodiments, the cushion (or inner cushion if it is encased by a cushion cover) is formed of two or more layers and/or types of foam materials having different degrees of firmness. For example, the cushion is optionally formed of two layers of foam material, a top foam layer and a bottom foam layer. The top foam layer and/or the bottom foam layer is optionally a polyurethane foam or contains polyurethane. The bottom foam layer is optionally glued to the top foam layer and optionally includes a cut-out. The two or more layers of foam material are optionally wrapped with a batting material. The batting material can be formed of various fibrous materials including, but not limited to cotton, polyester or wool, and bamboo fibers.

The cut-out has the same size and shape as the attachment region on the cushion cover and is configured to align with the attachment region when the cushion is inside the cushion cover. Similarly, if the seat cushion does not contain a cushion cover, the cut-out is in a location that aligns with the location of the attachment region on the back portion of the seat cover. Alternatively, the cushion (or inner cushion if it is encased by a cushion cover) is formed of a single foam material. Optionally the cushion or inner cushion material includes a has a cut-out, as described above, in the bottom of the foam material, where the cut out has the same shape and size as the top of the plug. The cut-out is located in the same location as the attachment region on the cushion cover, and configured to align with the attachment region when the cushion is inside the cushion cover. Optionally for embodiments in which the cushion does not contain a cushion cover, the cushion can be molded in a suitable configuration to include an indentation or cut-out portion having a suitable size and shape to receive the top portion of a plug.

Figure 16B:
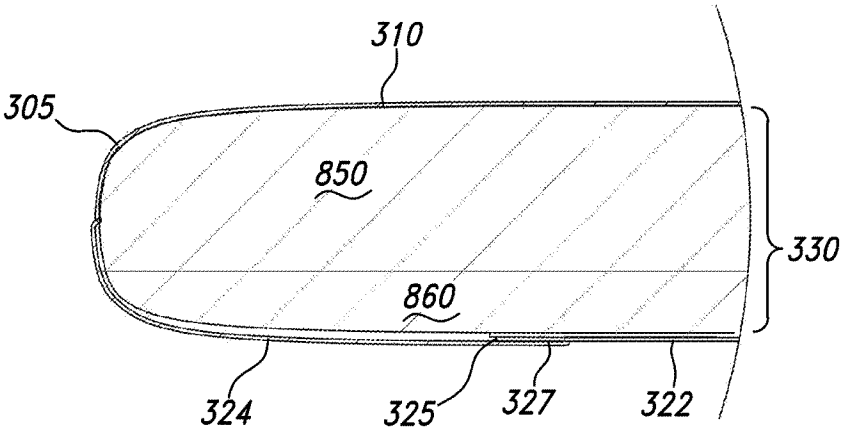
FIGS. 16A-16C are different views of an exemplary seat cushion with a removeable cover.
Figure 16C:
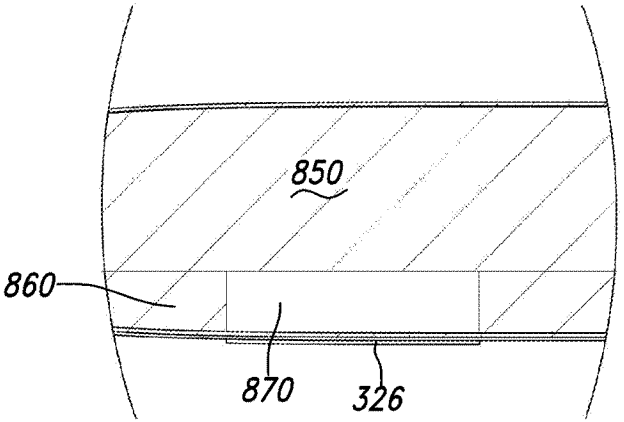
Figure 16A:
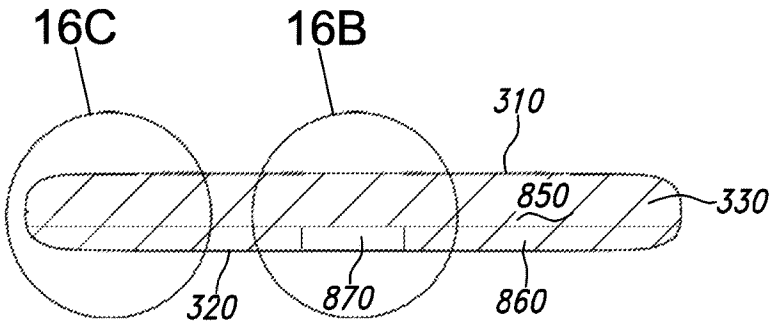

Cross-sectional views of an exemplary seat cushion containing an inner cushion material are provided in FIGS. 16A-16C. As shown in FIG. 16A, the seat cushion 300 contains a removeable cushion cover 305 encasing the inner cushion 330.

The removeable cushion cover 305 contains a front portion 310 and back portion 320 which are joined together and surround the inner cushion 330. The back portion optionally contains an opening to facilitate insertion and removal of the inner cushion. The opening can be formed between a first material 322 and a second material 324. The bottom edge 327 of the second material 324 can cover the top edge 325 and, optionally also an upper portion, of the first material 322 (see, e.g., FIGS. 4D and 16B).

As shown in FIGS. 16B and 16C, the inner cushion is formed of two layers having different levels of firmness. For example, as shown in FIG. 16C, the cushion is formed of two layers of foam materials, a top foam layer 850 and a bottom foam layer 860. The bottom foam layer 860 is configured to compress to the thickness of the plug via a cut-out 870 in the bottom foam layer 860. The bottom foam layer 860 adheres, such as via glue, to the top foam layer 850 and has a cut-out 870 having the same shape and size as the top of the plug. The cut-out is located in the same location as the attachment region 326 on the cushion cover, and configured to align with the attachment region when the cushion is inside the cushion cover.

Similarly, if the seat cushion does not contain a cushion cover, the cut-out, if present, is in a location that aligns with the location of the attachment region 326 on the back portion of the seat cover. As depicted in FIG. 16A, since the cushion cover incudes an attachment region in the center of the cushion cover, the cut-out 870 is also located in the center of the inner cushion. The bottom foam layer 860 can be formed of a filling material e.g., batting material.

1. Stand Alone Seat Cushion (Without Removable Cover)

Optionally, the cushion contains one or more cushion materials without a removeable cushion cover, thereby forming a stand-alone seat cushion. For example, the stand-alone seat cushion optionally includes an outer coating and/or a molded skin. When the stand-alone seat cushion is encased in a molded skin, the molded skin is optionally formed of and/or coated with an outer coating to prevent or reduce liquid absorption by the one or more cushion materials. The outer coating is optionally a polyurethane coating.

The stand-alone seat cushion can have any suitable shape as long as it fits on the top surface of the seat portion. For example, the stand-alone seat cushion can have a regular or irregular shape. Optionally, the stand-alone seat cushion is a rectangle, circle, oval, square, hexagon, heptagon, octagon, or any suitable shape that fits on the seat portion of the seat module.

The stand-alone seat cushion typically has a front surface, a back surface, and one or more side surfaces. The back surface is optionally formed of and/or coated with a material that provides a friction or resistance element to prevent or reduce sliding of the cushion when it is on top of the seat module. Optionally, a non-slip material, such as a non-slip patch, non-skid pad, and/or gripper liners/pad, is attached to the back surface to prevent or reduce sliding of the cushion when it is on top of the seat module. Suitable materials to be attached to or coated on the back surface to increase resistance between the cushion cover and the seat portion include but are not limited to polyester woven fabric with non-slip PVC or silicone coatings.

The back surface contains one or more attachment regions, which are configured to be attachable to and removable from the fastening mechanism on the top portion of the plug, as described above with respect to the cushion cover.

Figure 17B:
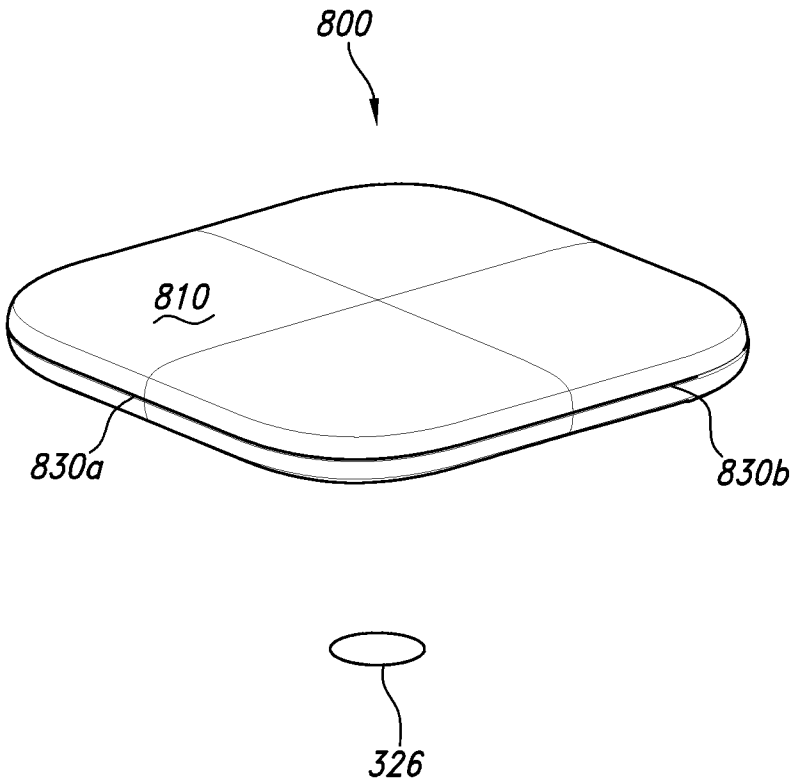
FIGS. 17A-17B are different views of an of an exemplary seat cushion without a removable cushion cover attached to its outer surface.
Figure 17A:
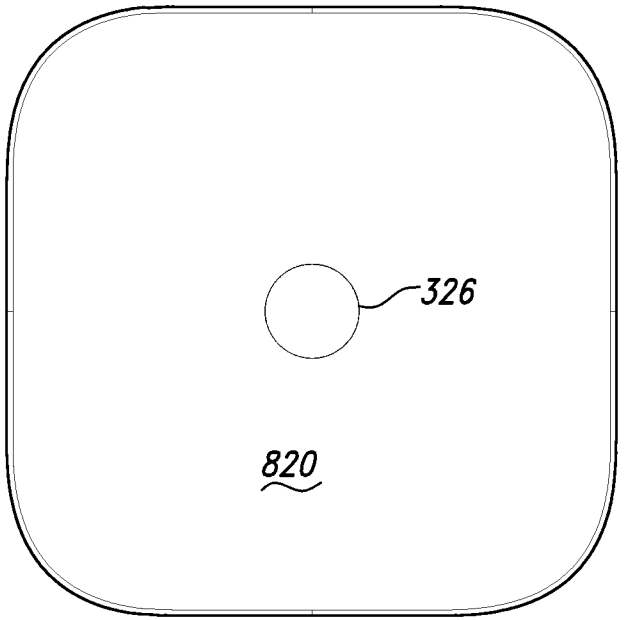

An exemplary seat cushion without a removeable cover is illustrated in FIGS. 17A-17B. As shown in FIGS. 17A and 17B, the stand-alone seat cushion 800 has a front surface 810, a back surface 820, and side surface (830*a* and 830*b*). The back surface 820 is optionally coated with a material to prevent or reduce sliding of the cushion when it is on top of the seat module. As shown in FIGS. 17C and 17D, the back surface 820 of the stand-alone seat cushion 800 contains an attachment region 326 configured to be attachable to and removable from a fastening mechanism on the top portion of a plug via any suitable fastener mechanism, such as magnet, mechanical clip, button, snap, adhesive, tape, loop, clip, or Velcro® (hook or loop fastener) attachment interface. The attachment region 326 is typically at least as long and as wide as the cross-section of the top portion of the plug.

D. Leg Modules

Each seat module is typically attached two or more leg modules to form a chair containing four legs descending from the seat module. The leg(s) of the leg module can be formed from any suitable material to achieve the desired aesthetic appearance. For example, the legs can be metal, such as stainless steel or chrome; wood, such as teak, oak, walnut, etc.; or plastic.

A leg module contains at least one leg and optionally two legs. Typically, the leg modules include a connecting element, such as a connecting bar, which is configured to attach the leg module to the seat module. In embodiments in which the leg module includes two legs, the connecting element, such as a connecting bar, can also connect the legs to each other.

In some embodiments, each leg module includes two legs that are connected to each other and extend downward from a connecting bar. In a set of two leg modules, each leg module typically contains a notch substantially in the center of the connecting bar, with the first leg module having the notch at the bottom of the connecting bar, and the second leg module having the notch at the top of the connecting bar. When assembled in a chair, the first connecting bar of the first leg module optionally crosses the second connecting bar of the second leg module, such that the notches align and meet, and the first and second leg modules are attached to each other and to the bottom surface of a seat module via a connection system.

Figure 5B:
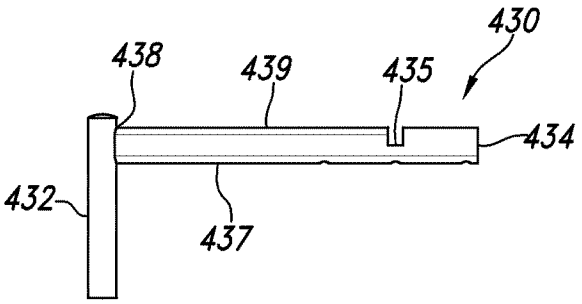
FIG. 5B is a side view of a leg module 400' containing one leg 432.
Figure 5C:
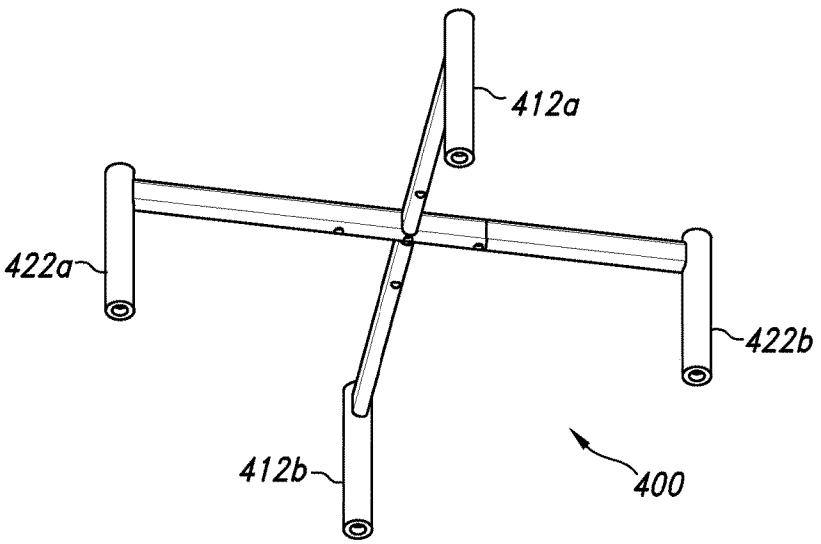
FIG. 5C is a perspective view of a set of leg modules.
Figure 5A:
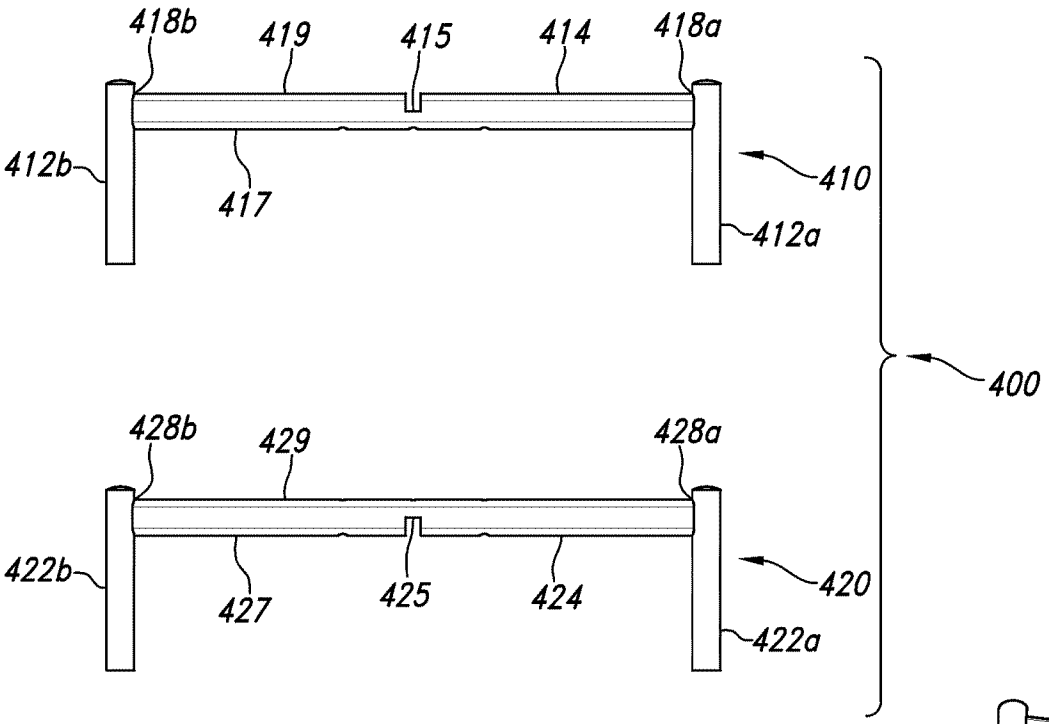
FIG. 5A is a side view of a set of leg modules 400 containing two leg modules 410 and 420.

For example, as shown in FIGS. 5A and 5C, a set of leg modules 400 contains a first leg module 410 and a second leg module 420. The first and second leg modules are substantially the same, with the exception of the connection region 415, 425. Each leg module contains a first leg 412*a*, 422*a*, a second leg 412*b*, 422*b* and a connecting bar 414 or 424. The connecting bar 414 or 424 contains a first end 418*a* or 428*a* and a second end 418*b* or 428*b*, where the first leg 412*a* is attached to and extends downward from the first end 418*a* of the first connecting bar 414 and the second leg 412*b* is attached to and extends downward from the second end 418*b* of the first connecting bar 414, and where the first leg 422*a* is attached to and extends downward from the first end 428*a* of the second connecting bar 424 and the second leg 422*b* is attached to and extends downward from the second end 428*b* of the second connecting bar 424.

The leg modules can be attached to the seat in any suitable manner to assemble a seat with four legs. In some instances, each of the two leg modules is attached diagonally along the bottom surface of the seat portion, such that the connecting bar of the first second module crosses the connecting bar of the first leg module, i.e. the two connecting bars from an "X" along the bottom surface of the seat portion. The two connecting bars attach to each other at the connection regions 415 and 425, which are typically located in the middle of each connecting bar 414 and 424, respectively. The connection region of the first leg module in each set is configured to fit inside and mate with the connecting region of the second leg module in the set. For example, each connection region can be a notch or depression in the connecting bar, where the notch 415 on the first leg module 410 is located on the top side 419 of the connecting bar, while the notch 425 on the second leg module 420 has a suitable size and shape to conform to and fit inside the notch 415 on the first leg module and the notch on the second leg module is located on the bottom side 427 of the connecting bar of the second leg module.

In some embodiments, a leg module contains one leg to anchor a corner seat module when two or more seat modules are joined together, such as in a three-seat sofa, four-seat sofa or sectional. FIG. 5B illustrates an exemplary leg module 430 containing one leg 432 attached to a connecting bar 434 and descending from the connecting bar at and end 438. In this embodiment, the connecting bar 434 contains a connecting region in the form of a notch or depression 435 in the top side 439 to allow attachment of the leg module 430 to a connection system in a corner seat module. Optionally the notch can be absent or located on the bottom side 437 of the connecting bar.

Optionally, each of the one or more legs in a leg module contains a gap at the end of the leg that is adjacent to the floor or ground that is configured to receive a glider plug, cap, or other fixture for increasing friction, preventing sliding of the furniture, and/or preventing damage to the floor.

E. Connection Components

The furniture contains one or more connection components to secure the leg module to the seat module and/or attach two or more seat modules to each other.

In one embodiment, the furniture contains one or more attachment bars to attach two or more seat modules together. Optionally, the attachment bar has two ends joined by a linking bar. Optionally, each of the ends is flat or curved and may contain one or more holes to receive a fastener or screw. Optionally, each of the ends is connected to the linking bar at an angle of at least 90°. The attachment bar may be formed of any suitable material including but not limited to metal, such as steel, stainless steel, or aluminum, wood, or plastic.

The furniture contains one or more connection systems for orienting and securing the leg modules to the connection port of the seat module. Optionally, the connection system includes a connection plate, containing holes to receive fasteners for securing the leg module to the connecting port of the seat module. Generally, the connection system includes one or more fasteners for securing the leg module to connection port of the seat module. Exemplary fasteners include but are not limited to rivets, screws, washers, nails, anchors, nuts such as but not limited to well nuts and jack nuts, bolts, staples, and/or hooks. Optionally, the fasteners are made of sustainable and/or recyclable materials e.g., rubber, plastic, etc.

When the connection system includes a connection plate, the connection plate optionally contains a top part and a bottom part. Optionally, the top part has a top surface and a bottom surface, and contains one or more holes to receive fasteners for securing the leg module to the seat module. Optionally, the top surface of the top part is substantially flat.

Optionally, the bottom part of the connection plate contains two or more panels extending from the bottom surface of the top part at an angle of at least 90 degrees. Optionally, two or more panels are configured to form one or more channels for receiving and orienting the leg modules, and securing the leg module to the connecting port of the seat module. The connection system may be formed of any suitable material including but not limited to metal, such as steel, stainless steel, or aluminum, or plastic.

Figure 6A:
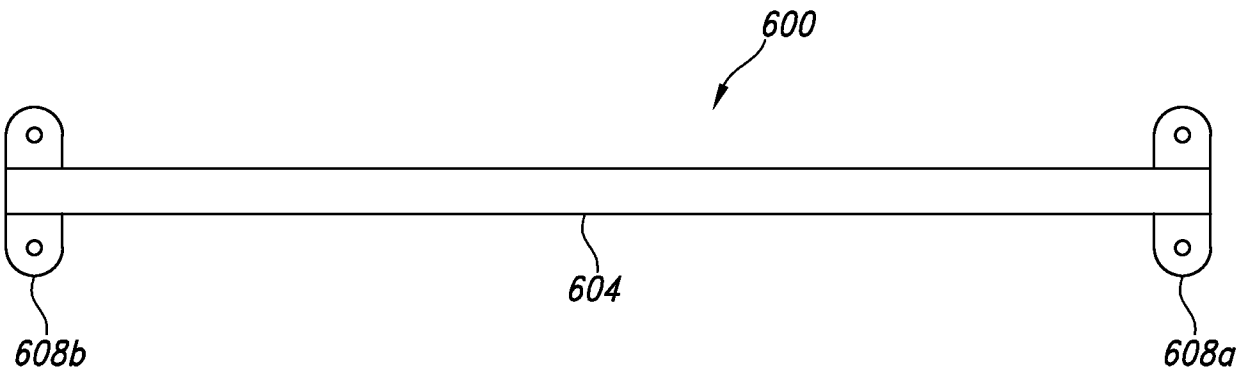
FIGS. 6A and 6B are a top view and side view, respectively, of an exemplary attachment bar 600 containing two ends 608*a* and 608*b* joined by a linking bar 604.
Figure 6B:
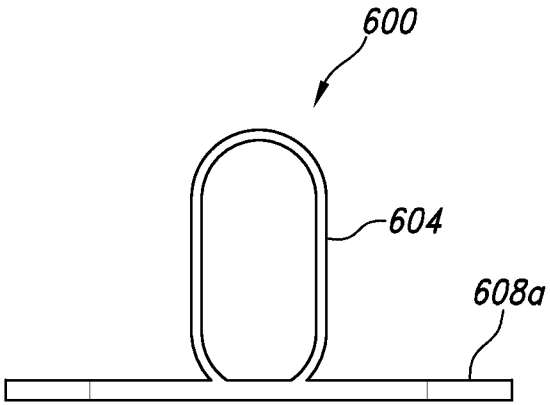

Exemplary connection components are illustrated in FIGS. 6A and 6B, and FIGS. 7A-7D. For example, FIGS. 6A and 6B are a top view and side view, respectively, of an exemplary attachment bar 600 containing two ends 608*a* and 608*b* joined by a linking bar 604. Each of the two ends 608*a*, 608*b* are connected to the linking bar at an angle of at least 90°. Each of the two ends 608*a* and 608*b* contain one or more holes for securing the attachment bar 600 to a seat module 100.

Figure 7C:
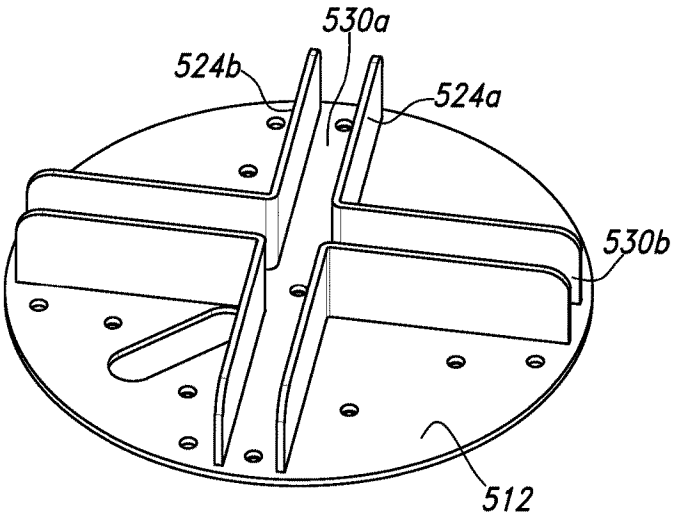
FIGS. 7C and 7D are perspective views of an exemplary connection plate.
Figure 7D:
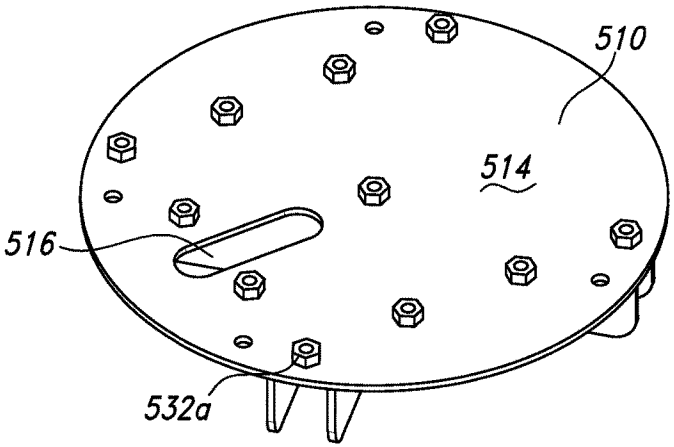
Figure 7A:
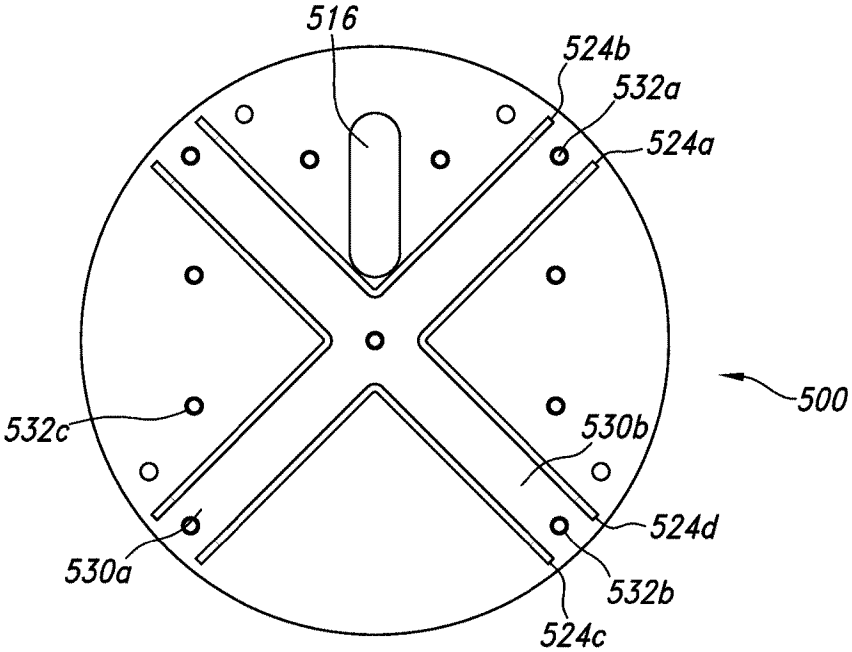
FIGS. 7A and 7B are a top view and side view of an exemplary connection plate.
Figure 7B:
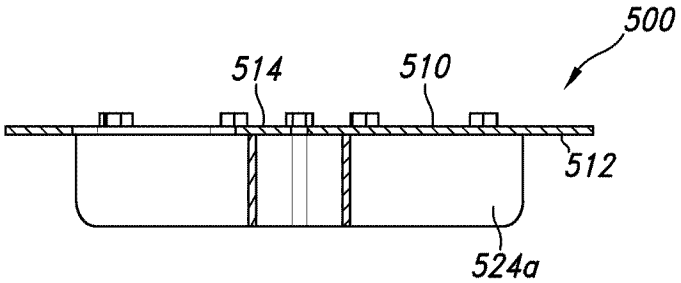

As shown in FIGS. 7A and 7B, an exemplary connection plate 500 contains a top part 510 and a bottom part 520. The top part 510 has a top surface 514 and a bottom surface 512, and contains one or more attachment regions, such as in the form of holes, configured to receive fasteners for securing the leg module to the seat module. The connect plate includes a slot 516, which has the same shape or a shape that is wider and longer than the slot 116 in the seat module. When assembled, the slot of the connection plate aligns with the slot of the seat module to permit the flow of water outside of the chair. Optionally, the bottom part 520 of the connection plate 500 contains two or more grooves or slots 530*a*, 530*b*, which are configured to align and maintain the connecting element of each leg module, when assembled. The grooves or slots can be formed by side walls 524*a*, 524*b* which extend from the bottom surface 512 of the connection plate 500, at a suitable angle, such as at an angle of at least 90°, such as at an angle in the range of about 120° to about 90°, about 120° to about 100°, or about 110° to about 90°. As shown in FIG. 7A, a first set of side walls 524*a*, 524*b* extend from the bottom surface 512 of the connection plate 500 and form a first slot 530*a*. Similarly, a second set of side walls 524*c*, 524*d* extend from the bottom surface 512 of the connection plate 500 and form a second slot 530*b*. The first set of side walls and the second set of side walls intersect, such that together, the two sets of side walls form intersecting grooves 530*a*, 530*b* configured in the shape of an "X".

The connection plate 500 contains one or more attachment regions, typically a plurality of attachment regions, such as in the form of holes 532*a*, 532*b*, 532*c*, configured to receive fasteners for securing the connection plate to the seat module and for securing the leg module to the connection plate and seat module. Optionally, the attachment regions are raised on the top surface of the connection plate to facilitate placement and alignment with corresponding attachment regions on the bottom surface of the seat module (see, e.g., FIGS. 7B and 7D).

When assembling a chair, each of the intersecting grooves, 530*a*, 530*b*, receives a connecting bar of one of the leg modules and orients the leg modules to form a chair with four legs descending from the bottom of the seat module. Each connecting bar can be secured to one of the holes (e.g. 532*a*, 532*b*) in the connection plate and thus to the connecting port 140 of the seat module using one or more, typically at least two, fasteners. Exemplary fasteners include but are not limited to rivets, screws, washers, nails, anchors, nuts such as but not limited to well nuts and jack nuts, bolts, staples, and/or hooks. Optionally, the fasteners are made of sustainable and/or recyclable materials e.g., rubber, plastic, etc.

II. Use of Furniture and Assembly of Modular Furniture

While the furniture described herein is suitable for use both indoors and outdoors, some of the features are particularly beneficial for use outdoors. Additionally, the flexibility of the modular design of the disclosed furniture makes is suitable for residential use, e.g., homes, apartments, and dorm rooms, as well as for commercial use, e.g., hotels, schools, businesses, and public areas.

A. Forming a Single Chair or Ottoman/Footrest

Each chair contains a seat module attached to at least one leg, typically attached to three or four legs, optionally attached to a set of two leg modules containing four legs descending from the seat module. A side chair generally refers to a chair in which the seat module has a backrest portion. A corner chair generally refers to a chair in which the seat module has a backrest portion and a side portion. An ottoman generally refers to furniture in which the seat module contains a seat portion but does not contain a backrest portion nor any side portions. Each ottoman also is attached to at least one leg, typically attached to three or four legs, optionally attached to a set of two leg modules containing four legs descending from the seat module.

1. Forming a Corner Chair

Figure 8B:
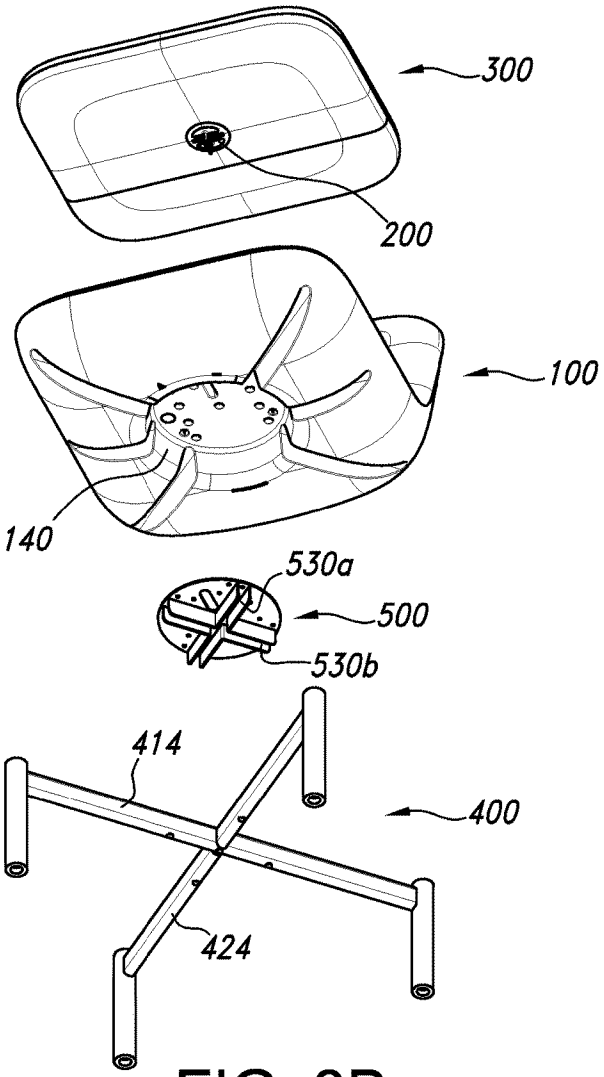
FIGS. 8A and 8B are exploded views of exemplary corner and side chairs, respectively. Each chair contains a seat cushion 300, seat module 100, 100', and set of leg modules 400. The seat cushion 300 is placed on top of the seat portion 112, 112' of each seat module 100, 100' and retained in its location by inserting the bottom portion of the detachable plug 200 into the slot 116. Each of the leg modules in the set 400 is connected to the seat module 100, 100' via the connection plate 500.
Figure 8A:
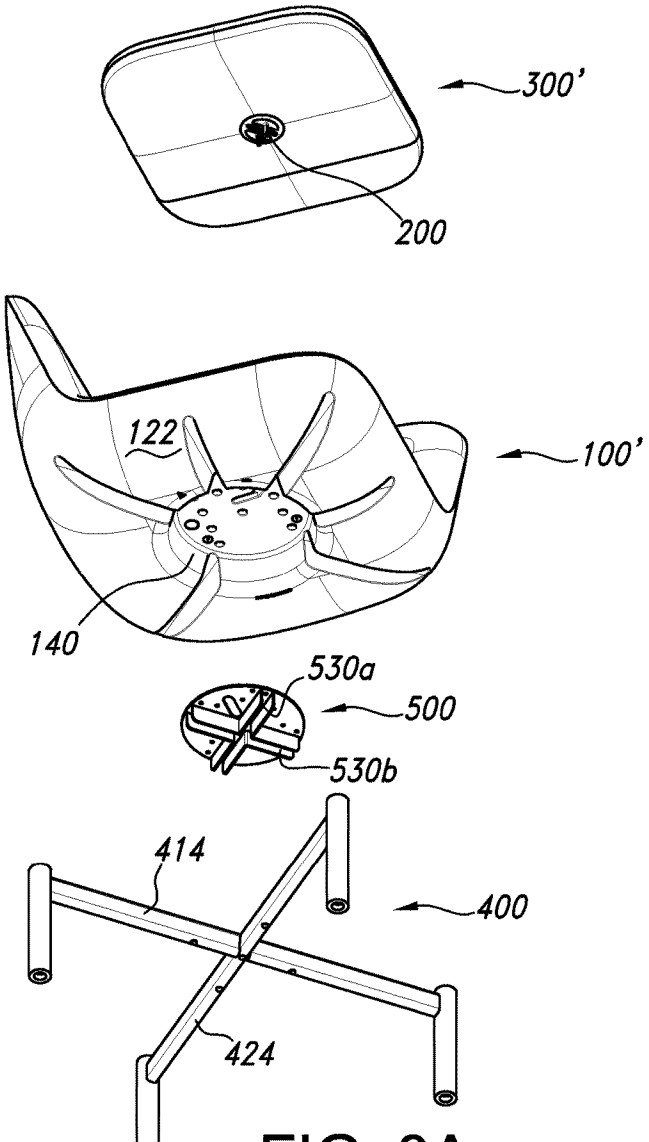

For example, as shown in FIG. 8A, an exemplary corner chair contains a corner seat module 100', which contains a backrest portion 114', a seat portion 112', and a side portion 118, to which the set of leg modules 400 are attached via the connection plate 500 and suitable fasteners (not shown) to the connecting port 140 in the bottom surface 122 of the seat module 100'. After assembling the corner chair, a removable seat cushion 300' can be placed on the seat portion 112' of the seat module (see, e.g. FIG. 2A) by inserting the detachable plug 200 into the slot 116 of the seat portion 112'. The set of two leg modules 400 is secured to the seat module 100' by inserting the connecting bar 414, 424 of each leg module into one of the grooves/slots 530*a*, 530*b* in the connection plate 500 and securing the connecting bars 414, 424 to the connecting plate 500 and the connecting port 140 of the seat module using one or more, typically at least two, optionally more than two, such as three, or four fasteners.

2. Forming a Side Chair

As shown in FIG. 8B, an exemplary side chair contains a seat module 100 containing a backrest portion 114 and a seat portion 112 (but not containing a side portion 118), to which the set of leg modules 400 are attached via the connection plate 500 and suitable fasteners (not shown) to the connecting port 140 in the bottom surface 122 of the seat module 100. After assembling the chair, a removable seat cushion 300 can be placed on the seat portion 112 of the seat module by inserting the bottom portion 220 of the detachable plug 200 into the slot 116 of the seat portion 112 (see, e.g. FIG. 3G). The set of two leg modules 400 is secured to the seat module 100 by inserting the connecting bar 414, 424 of each leg module into one of the grooves/slots 530*a*, 530*b* in the connection plate 500 and securing the connecting bars 414, 424 to the connecting plate 500 and the connecting port 140 of the seat module using one or more, typically at least two, optionally more than two, such as three, or four fasteners.

3. Forming an Armchair

As shown in FIGS. 12A-12D, an exemplary armchair 1000", contains a backrest portion 114", seat portion 112", and two side portions 120*a*, 120*b*. The plane of the backrest portion 114" and the planes of each of the side portions 120*a*, 120*b* each intersect with the seat portion 112" at the same or substantially the same angle. The backrest portion 114" and the side portions 120*a*, 120*b* connect with each other at an angle of 90° or greater and less than 180°, typically at an angle greater than 90° and less than 180°, such as greater than 90° and less than 170°, greater than 90° and less than 160°, greater than 90° and less than 150°, greater than 90° and less than 140°, greater than 90° and less than 130°, greater than 90° and less than 120°, or greater than 90° and less than 110°.

One or more legs, such as four legs, as shown in FIGS. 12A-12D, can be attached to the seat module to form an armchair.

For example, a set of leg modules 400 can attach to a connecting port in the bottom surface 122 of the seat module 100. After assembling the chair, a removable seat cushion can be placed on the seat portion 112" of the seat module by inserting the bottom portion 220 of the detachable plug 200 into the slot 116 of the seat portion 112 (see, e.g. FIGS. 12A and 12C).

Figure 12B:
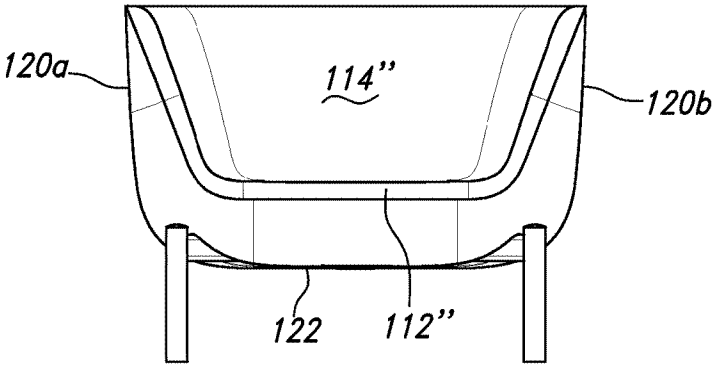
FIGS. 12A-12D are different views of an exemplary armchair.
Figure 12D:
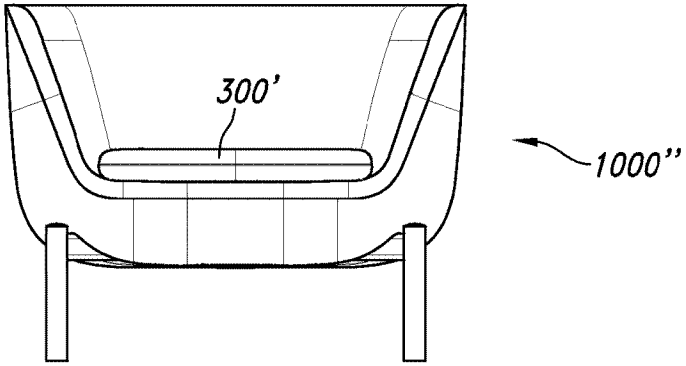
Figure 12A:
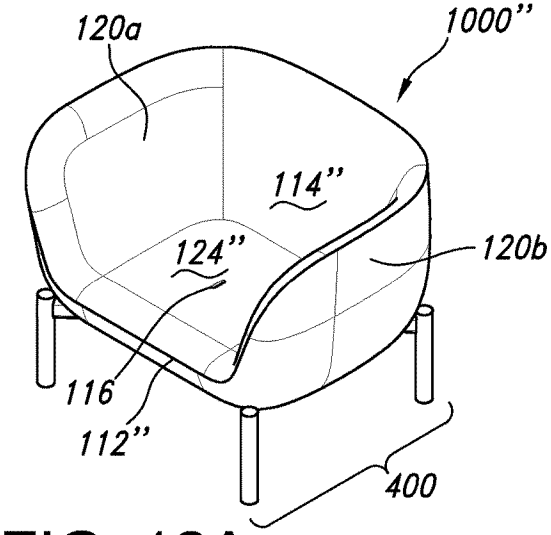
Figure 12C:
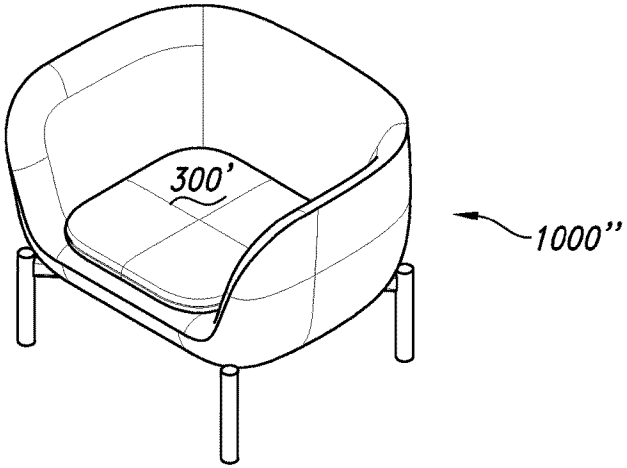

As shown in FIGS. 12A and 12B, the seat portion includes a top surface 124" and a bottom surface 122". The top surface 124" of the seat portion 112" typically includes a slot 116, configured to permit water drainage. As shown in FIGS. 12C and 12D, a seat cushion 300' can be placed on the top surface 124" of the seat portion 112". Optionally, the seat cushion 300' is retained in place on the top surface 124" of the seat portion 112" via a plug, which fits inside the top slot 116 and thereby orients the seat cushion and prevents the seat cushion from sliding off the top surface. A drainage system, such as depicted in FIGS. 1D-1G or FIGS. 10A-10D, can be included in the seat portion of the armchair.

The side portions can have any suitable shape and size to serve as an arm rest. As shown in FIGS. 12A-12D, the height of each side portion can be the same as the height of the backrest portion. Alternatively, the height of each side portion can be less than the height of the backrest portion. The side portions and back portions can be solid, hollow, and/or contain one or more open regions. For example, optionally each of the side portions has an open region or more than one open regions between the seat portion and the top surface of the side portion.

4. Forming an Ottoman or Footrest

Figure 13B:
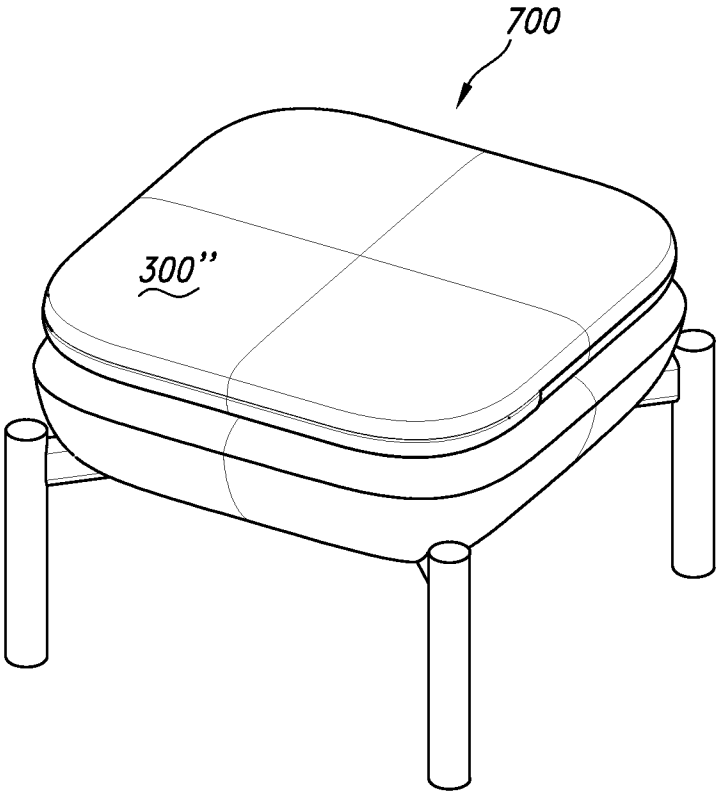
FIGS. 13A-13B are different views of an exemplary ottoman or seat.
Figure 13A:
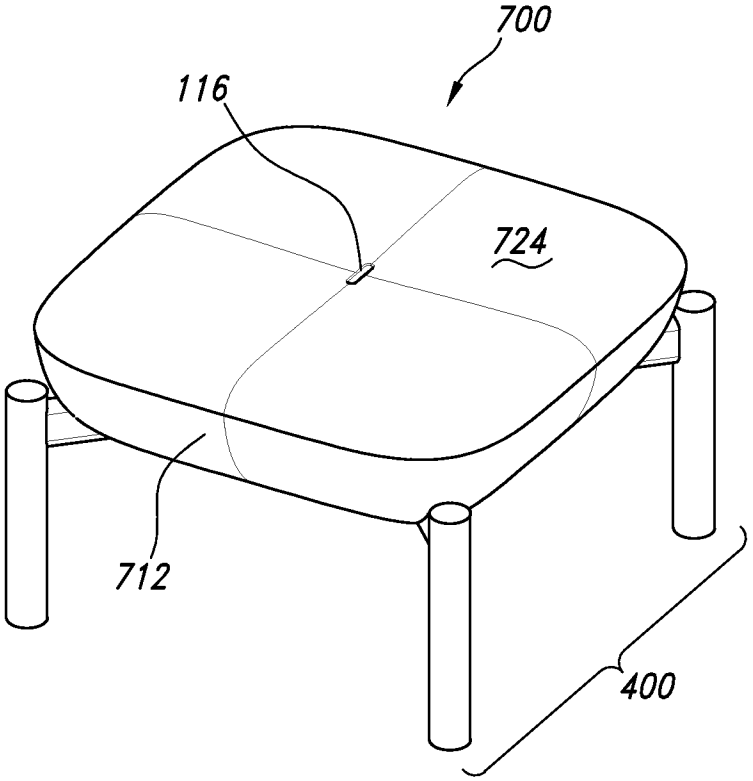

As shown in FIGS. 13A-13B, an exemplary ottoman 700, contains a seat module that contains a seat portion 712 and does not contain a backrest portion nor a side portion. One or more legs, such as four legs, as shown in FIGS. 13A-13B, can be attached to the seat module to form an ottoman. For example, a set of leg modules 400 can attach to a connecting port in the bottom surface 722 of the seat portion 712. In this embodiment, the seat module is the seat portion.

The seat portion 712 of the ottoman can have any suitable shape and size. As shown in FIGS. 13A-13B, the seat portion can have a top surface with a rectangular shape. As shown in FIG. 13A, the seat portion 712 has a top surface 724 and a bottom surface (not shown). The top surface 724 of the seat portion 712 typically includes a slot 116, configured to receive a tab of a plug. As shown in FIG. 13B, after assembling the legs to the seat portion to form an ottoman, a removable seat cushion 300" can be placed on the top surface 724 of the seat portion 712. Optionally, the seat cushion 300" is retained in place on the top surface 724 via a plug, which fits inside the slot 116 and thereby orients the seat cushion and prevents the seat cushion from sliding off the top surface. A drainage system, such as depicted in FIGS. 1D-1G or FIGS. 10A-10D, can be included in the seat portion of the ottoman.

B. Forming an Assembly of Furniture

An assembly of furniture can contain two or more chairs, or at least one chair and an ottoman or side table attached thereto. The chairs can be in the form of one or more corner chairs, one or more side chairs, or a combination thereof, optionally in combination with one or more ottomans.

The one or more side chairs, one or more corner chairs and one or more ottomans are described above. The assembly of furniture can be in the form of a two-seat sofa, three-seat sofa, or four-seat sofa, or optionally can contain more than four seats.

Two or more seat modules can be connected to each other using a connection system to form an assembly of furniture, such as in the form of a sofa or love seat. Each seat module is typically attached to a set of two leg modules to form a chair containing four legs descending from the seat module. The two leg modules are attached to the bottom surface of the seat module via the same or a different connection system.

Two or more seat modules can be connected to each other by attaching a linking device at one end to the bottom surface of one seat module and attaching the opposite end of the linking device to the bottom surface of a second seat module.

Two or more chairs can be connected to each other to form a variety of different seating arrangements. For example, a corner chair can be attached to a side chair to form a two-seat sofa. Optionally, a second corner chair can be attached to the opposite side of the side seat module to form a three-seater sofa. Optionally, two corner chairs can be attached to each other to form a two-seat sofa or a love seat. Additional suitable configurations of the chairs can be formed, such as forming a 4-seat, or 5-seat sofa, or even larger sofas. For example, one or more side chairs can be attached in series to lengthen the sofa. Optionally, a first side chair is attached on a first side of a corner chair and a second side chair is attached on the opposite side of the corner chair. Each or only one of the side chairs can be connected on its opposite side with another side chair or with a second corner chair.

One or more additional furniture pieces can be connected to the chairs in a variety of arrangements as desired. For example, one or more side tables can be attached to one or more side chairs and/or corner chairs. Optionally, the side table contains a shelf for storing items. Optionally, one or more footrests or ottomans can be used with an armchair, side chair and/or corner chair or a sectional containing a side chair and/or a corner chair.

1. Exemplary Two-Seat Furniture Assembly

Figure 9:
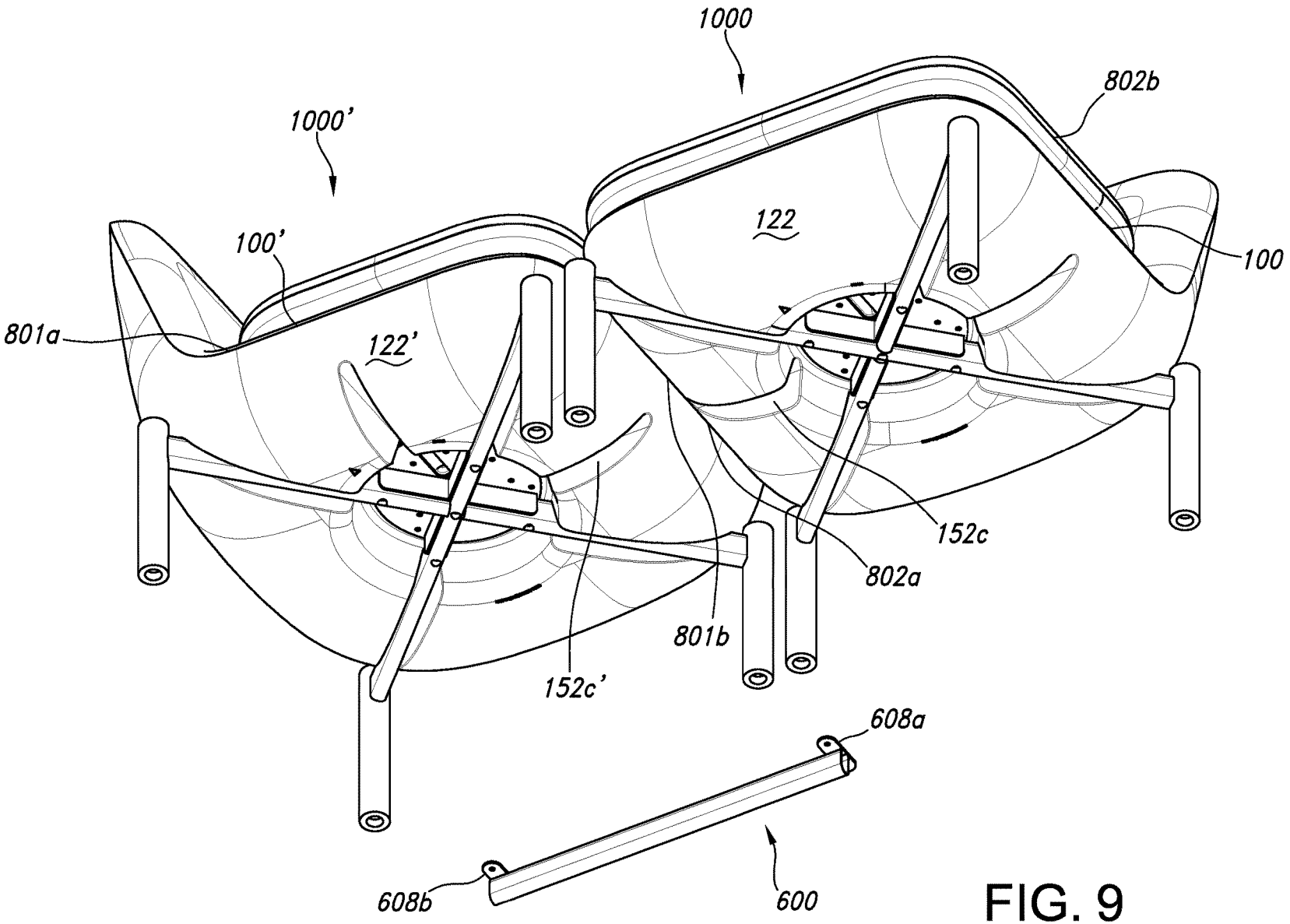
FIG. 9 is a bottom perspective view of two exemplary chairs showing how they are connected using an attachment bar 600.

As shown in FIG. 9, one side chair 1000 is connected to a corner chair 1000' via an attachment bar 600. A first end 608*a* of the attachment bar 600 is configured to fit in a first grooved junction 152*c* on the bottom surface 122 of the first seat module 100 and the second end 608*b* of the attachment bar is configured to fit in a second grooved junction 152*c'* on the bottom surface 122' of the second seat module 100'. In this configuration, the side chair 1000 is attached via a first side 802*a* of its seat portion to a second side 801*b* of the corner chair 1000'. Alternatively, two corner chairs that are configured to serve as opposite corners, can be attached directly to each other to form a two-seat sofa or can be attached to opposite sides 802*a*, 802*b* of the seat portion of the side chair 1000 to form a three-seat sofa.

2. Exemplary Four-Seat Furniture Assembly

Figure 14B:
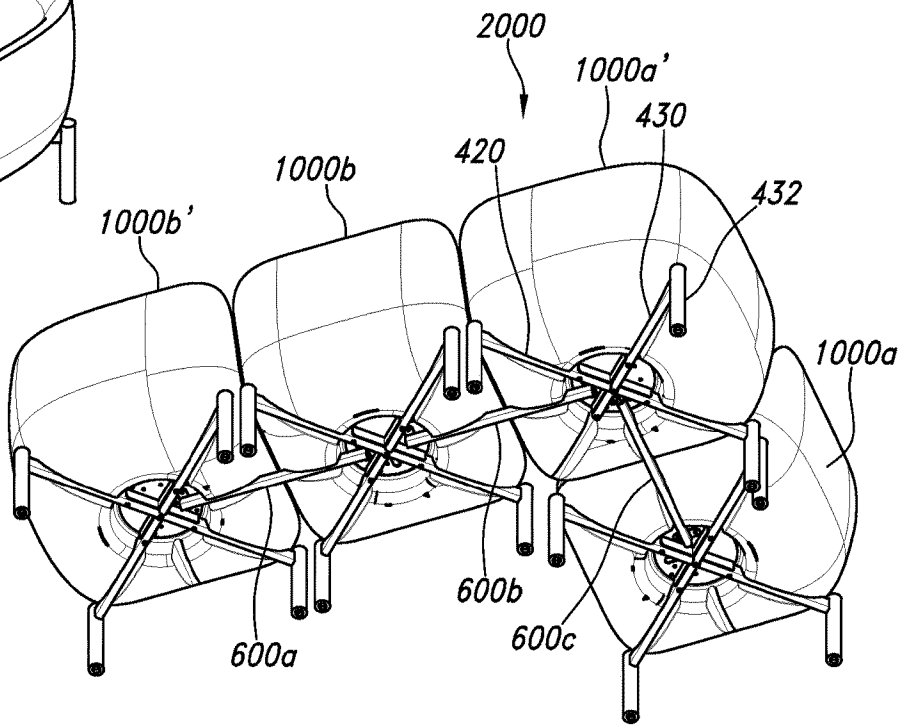
FIGS. 14A and 14B are different views of an exemplary four-seat sofa.
Figure 14A:
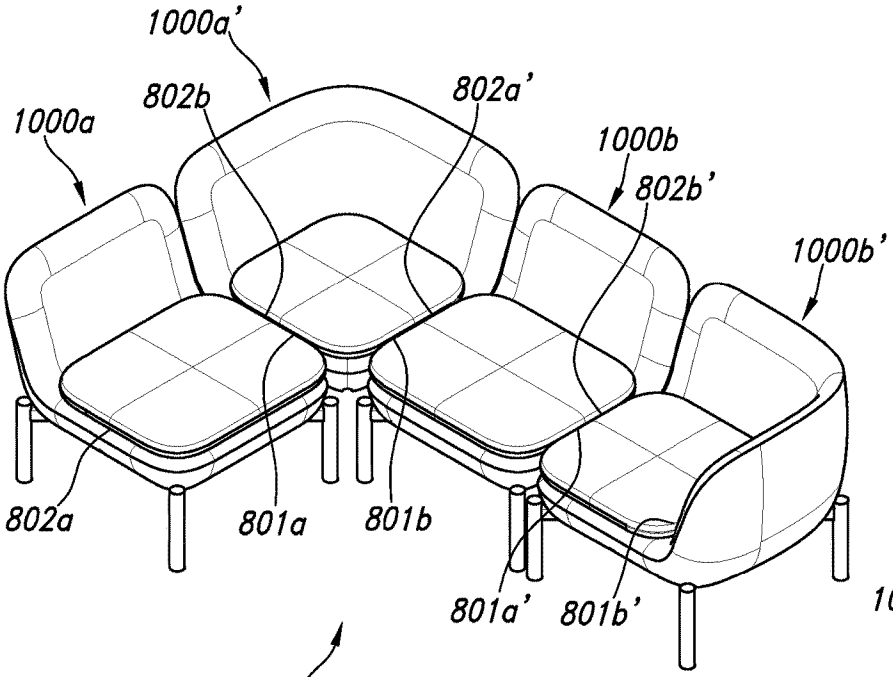

One configuration of an exemplary four-seat sofa 2000 is shown in FIGS. 14A and 14B. As shown in FIG. 14A, the sectional sofa can contain two corner chairs and two side chairs. For the first and second side chairs, the first and second sides of the seat module are not attached to a backrest portion and are located generally opposite to each other. For each of the first and second corner chairs, the first and second sides of the seat module are not attached to either a backrest portion or a side portion and are located substantially perpendicular to each other. In one configuration, a first side chair 1000*a* has a first side 802*a* of its seat portion, which is not attached to any furniture, and a second side 802*b* that is attached to a first corner chair 1000*a'*. The first corner chair 1000*a'* is attached via a first side 801*a* of its seat module to the second side 802*b* of the seat module of the first side chair 1000*a*. Additionally, the first corner chair is attached via a second side 801*b* of the seat module to a first side 802*a'* of the seat module for a second side chair 1000*b*. The second side chair 1000*b* is also attached via a second side 802*b'* of the seat module to a first side 801*a'* of the seat module of a second corner chair 1000*b'*. The second corner chair 1000*b'* also contains a second side 801*b'* of the seat module that is not attached to any furniture.

As shown in FIG. 14B, the side chairs 1000*a*, 1000*b* and the corner chairs 1000*a'*, 1000*b'* are connected to each other via attachment bars 600*a*, 600*b*, and 600*c*. The bottom surface of the seat module for each of the two side chairs 1000*a*, 1000*b* and the second corner chair 1000*b'* is attached to a set of leg modules, where each leg module has two legs. The bottom surface of the seat module of the first corner chair 1000*a'*, which is attached to both the first and the second side chairs, is attached to a first leg module 420 having two legs and the second leg module 430 having only a single leg 432. Thus, when assembled in this configuration, the first corner chair in the four-seat sectional sofa contains only three legs.

Although not shown in FIGS. 14A and 14B, additional furniture pieces, such as another side chair, another corner chair, or a side table, may be attached to the opposite side 802*a* of the first side chair 1000*a*.

3. Exemplary Three-Seat Furniture Assembly

Figure 15B:
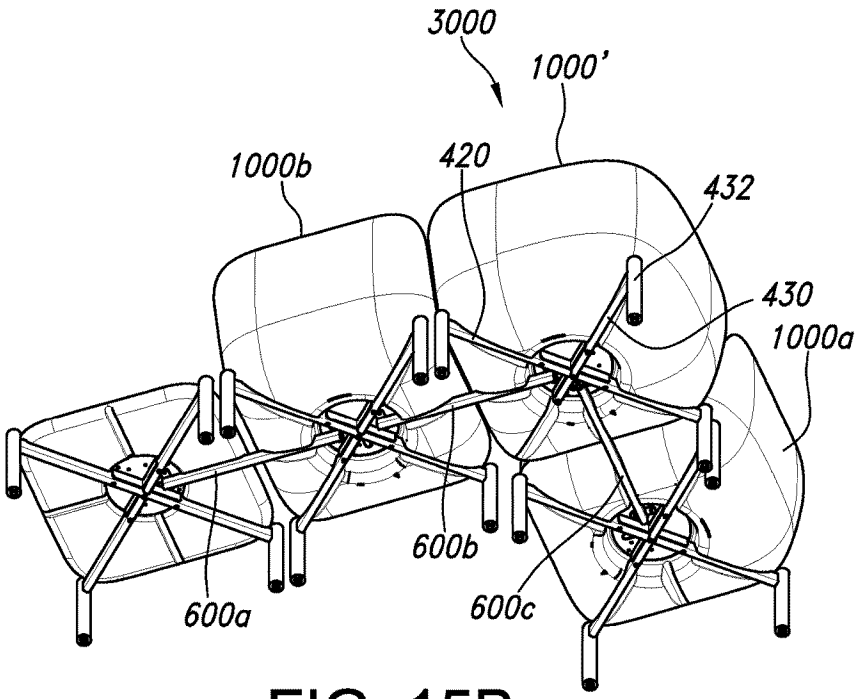
FIGS. 15A and 15B are different views of an exemplary three-seat sofa with an attached side table.
Figure 15A:
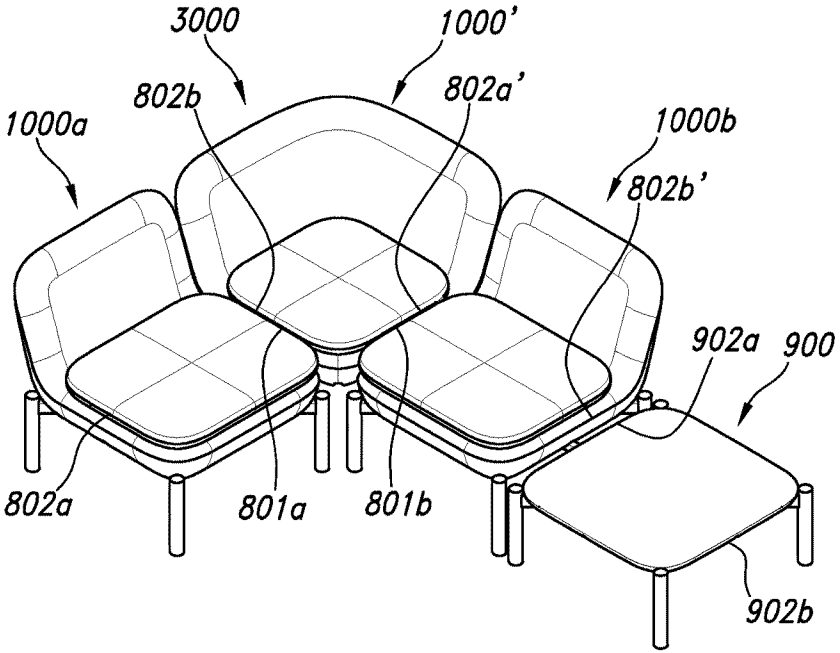

A three-seat sofa can contain one corner chair and two side chairs, optionally one of the side chairs is attached to a side table. An exemplary three-seat sofa 3000, optionally containing a side table 900, is shown in FIGS. 15A and 15B. The description above for the four-seat sofa generally applies to the three-seat sofa depicted in FIGS. 15A and 15B, with the exception that a side table is present in place of the second corner chair.

For each of the first and second side chairs, the first and second sides of the seat module are not attached to a backrest portion and are located generally opposite to each other. For the corner chair, the first and second sides of the seat module are not attached to either a backrest portion or a side portion and are located substantially perpendicular to each other.

As shown in FIG. 15A, in one configuration, a first side chair 1000*a* has a first side 802*a* of its seat portion, which is not attached to any furniture, and a second side 802*b* that is attached to a corner chair 1000'. The corner chair 1000' is attached via a first side 801*a* of its seat module to the second side 802*b* of the seat module of the first side chair 1000*a*. Additionally, the corner chair is attached via a second side 801*b* of the seat module, which is perpendicular to the first side of the seat module for the corner chair, to a first side 802*a'* of the seat module for a second side chair 1000*b*. The second side chair 1000*b* is also attached via a second side 802*b'* of the seat module to one side 902*a* of a side table 900.

As shown in FIG. 15B, the side chairs 1000*a*, 1000*b* and the corner chair 1000*a'* are connected to each other via attachment bars 600*a*, 600*b*, and 600*c*. The bottom surface of the seat module for each of the two side chairs 1000*a*, 1000*b* is attached to a set of leg modules, where each leg module has two legs. The bottom surface of the seat module of the corner chair 1000*a* is attached to a first leg module 420 having two legs and the second leg module 430 having only a single leg 432. Thus, when assembled in this manner, the corner chair in the three-seat sectional sofa contains only three legs.

Although not shown in FIGS. 15A and 15B, additional furniture pieces may be attached to the opposite side 902*b* of the side table 900, and/or to the opposite side 802*a* of the first side chair 1000*a*.

C. Use of the Seat Cushions

To increase the comfort of sitting in the seats described herein, seat cushions can be placed on top of the top surface of one or more seat modules.

When the cushion remains on the seat during a storm, the wind could blow against the cushion at a suitable force and at a suitable angle to separate the top portion of the plug from the back portion of the cushion. When this occurs, however, the cushion generally remains intact, and undamaged due to the force of the wind. Additionally, when the seat cushion is on the seat module, if water gathers beneath the seat cushion, it is able to drain through the slot in the top surface of the seat portion of the chair.

When the seat cushion is placed on the top surface of a chair or ottoman, the tab of the plug aligns with and fits in the slot of the seat module. The orients the cushion on the top surface. When the seat cushion is in place, the top portion of the plug lies on top of the seat portion and is attached to the seat cushion, while the bottom portion of the plug fits inside the slot. The bottom portion is located in the slot in a manner that allows for its easy removal, as desired, such as to store or clean the seat cushion. Also in the case of a storm, the force of the wind can push the cushion upward and thereby remove the bottom portion from the top opening, such as a slot, without damaging the seat cushion (e.g., avoiding ripping or tearing that could otherwise occur if the seat cushion was tied or strapped to the chair).

Optionally, one or more back cushions can be placed against the backrest portion of one or more seat modules. Optionally, the backrest portion contains one or more slots configured to receive the bottom portion of a plug, as described herein with respect to the seat cushions. Optionally, a plug is attached to the back portion of the cover of a back cushion or of the back cushion itself if it does not contain a removable cover, as described above with respect to the seat cushions. Then the bottom portion of the plug is inserted into a correspondingly sized slot in the backrest portion of a seat module. The slot orients and aligns the back cushion against the backrest portion of the seat module in a chair or sofa.

III. Exemplary Kits for Forming Modular Furniture and Assemblies of Furniture The modular furniture and furniture assemblies described herein can be formed from one or more kits containing the furniture components.

For example, a kit for forming a chair or an ottoman can include:

(i) a seat module, as described above;

(ii) a removable seat cushion that has a suitable size and shape to fit on top of the seat portion of the seat module;

(iii) a first leg module containing a first connecting bar and two legs, wherein each leg is attached to an opposite end of the first connecting bar;

(iv) a second leg module comprising a second connecting bar and one leg or two legs; and (v) one or more connecting elements.

As described above, the seat module generally contains at least one top opening in the seat portion the seat cushion contains a plug that includes a bottom portion that is configured for insertion into the top opening of the seat portion and is slidably removable therefrom.

The connecting elements are configured to secure the first and second leg modules to the seat modules. For example, the connecting elements include, but are not limited to, attachment bars, connection plates, and fasteners.

In some instances the kit includes two or more seat modules. Optionally all of the seat modules have the same configuration. Optionally, one or more of the seat modules has a different configuration from the other seat modules. For example, the kit can include one or more side seat modules and one or more corner seat modules. Optionally the kit includes an ottoman seat module.

An ottoman seat module contains a seat portion but does not contain a backrest portion or a side portion. A side seat module contains a seat portion and a backrest portion. A corner seat module contains a seat portion, a backrest portion and a side portion. For the side seat module and the corner seat module, the backrest portion and the side portion, if present, are each in a plane that intersects with the top surface of the seat portion at an angle of 90° or greater, and less than 180°.

Optionally one or more of the seat modules in the kit is an armchair seat module. The armchair seat module includes a seat portion, backrest portion, and two side portions. The backrest portion and the side portions each lie in different planes that intersect with the plane of the top surface of the seat portion at the same or substantially the same angle.

The disclosed chairs, assemblies of furniture, kits, and methods of use can be further understood through the following numbered paragraphs.

1. A chair comprising a seat module comprising a seat portion, wherein the seat portion comprises a top opening, optionally in the form of a slot, configured to permit water to drain therethrough.
2. The chair of paragraph 1, wherein the seat module further comprises a backrest portion, wherein the backrest portion is at an angle of 90° or greater and less than 180° relative to the top surface of the seat portion.
3. The chair of paragraph 1 or 2, further comprising a removable seat cushion, wherein the cushion has a suitable size and shape to fit on top of the seat portion, and wherein the cushion is attached to a plug, wherein the plug comprises a bottom portion, optionally in the form of a tab, wherein the bottom portion is configured for insertion in the top opening of the seat portion and is removable therefrom,
4. The chair of any one of paragraphs 1 to 3, wherein the removable seat cushion comprises a front portion and a back portion, wherein the back portion comprises at least one attachment region for releasably attaching to the plug.
5. The chair of any one of paragraphs 1 to 4, wherein the removable seat cushion comprises a cushion cover and an inner cushion inside the cushion cover, and, wherein the front portion and the back portion are parts of the cushion cover.
6. The chair of any one of paragraphs 1 to 5, wherein the plug further comprises a top portion, wherein the top portion is releasably attached to the seat cushion,
7. The chair of any one of paragraphs 1 to 6, wherein the top portion of the plug is substantially flat and comprises a hook and loop fastener material attached thereto.
8. The chair of any one of paragraphs 1 to 7, wherein the top portion of the plug is affixed to the bottom portion of the plug and is substantially perpendicular to the bottom portion of the plug.

9. The chair of any one of paragraphs 1 to 8, wherein the bottom portion of the plug comprises at least one bottom channel configured to facilitate water flow through the slot of the seat module.
10. The chair of any one of paragraphs 1 to 9, wherein the bottom portion of the plug comprises at least one bottom channel configured to facilitate water flow when the bottom portion of the plug is inside the slot of the seat module.
11. The chair of any one of paragraphs 1 to 10, wherein the bottom side of the top portion of the plug comprises one or more top channels, wherein the top channels are in fluid communication with the bottom channels.
12. The chair of any one of paragraphs 1 to 11, further comprising three or four legs that descend from the seat module.
13. The chair of any one of paragraphs 1 to 12, further comprising two leg modules, wherein each leg module comprises a connecting bar and a leg.
14. The chair of any one of paragraphs 1 to 13, wherein one or more of the leg modules further comprises a second leg, and wherein each leg descends from the seat module.
15. The chair of any one of paragraphs 1 to 14, wherein the first leg module comprises two legs, wherein each leg is attached to an opposite end of the connecting bar and the second leg module comprises one leg attached to one end of the connecting bar, or wherein each of the leg modules comprises two legs, wherein each leg is attached to an opposite end of the connecting bar.
16. The chair of any one of paragraphs 1 to 15, further comprising two leg modules attached to the bottom of the seat portion, wherein each leg module comprises a connecting bar and a leg attached to one end of the connecting bar.
17. The chair of any one of paragraphs 1 to 16, wherein at least one of the leg modules further comprises a second leg, and wherein each leg descends from the seat module.
18. The chair of any one of paragraphs 1 to 17, wherein the backrest portion comprises one or more back openings.
19. The chair of any one of paragraphs 1 to 18, wherein each back opening is in the form of a slot.
20. The chair of any one of paragraphs 1 to 19, wherein the backrest portion comprises a back slot.
21. The chair of any one of paragraphs 1 to 20, further comprising further comprising a removable back cushion, wherein the back cushion is attached to a plug, wherein the plug comprises a bottom portion, optionally in the form of a tab, wherein the bottom portion is configured for insertion in the back opening and is removable therefrom.
22. The chair of any one of paragraphs 1 to 21, further comprising a side portion, wherein the side portion intersects with the seat portion at the same angle as the backrest portion.
23. The chair of any one of paragraphs 1 to 22, wherein the backrest portion and the side portion are attached to each other.
24. The chair of any one of paragraphs 1 to 23, further comprising two side portions, wherein each side portion intersects with the seat portion at the same angle as the backrest portion.
25. The chair of any one of paragraphs 1 to 24, wherein the backrest portion is attached to each of the side portions.
26. The chair of any one of paragraphs 1 to 25, further comprising one or two side portions, wherein each of the side portions is located in a plane that intersects with the plane of the seat portion at the same angle as the plane of the backrest portion.
27. An assembly of furniture comprising a first chair of any one of paragraphs 1 to 26, and a second chair of any one of paragraphs 1 to 26, wherein the first and the second chairs have the same configurations or wherein the first and the second chairs have different configurations.
28. An assembly of furniture comprising two or more side chairs, each of said two or more side chairs being a chair of any one of paragraphs 1 to 26, wherein each side chair comprises a seat portion and a backrest portion, wherein the backrest portion is at an angle of 90° or greater and less than 180° relative to the top surface of the seat portion, and two or more corner chairs, each of said two or more corner chairs being a chair of any one of paragraphs 1 to 26, wherein each corner chair comprises a seat portion and a backrest portion and two side portions, wherein the side portions and backrest portions intersect with the seat portion at an angle of 90° or greater and less than 180° relative to the top surface of the seat portion.
29. An assembly of furniture comprising one or more corner chairs, one or more side chairs, or a combination thereof, each of said one or more corner chairs and/or said one or more side chairs being a chair of any one of paragraphs 1 to 26, wherein each of the one or more side chairs comprises a seat portion and a backrest portion, wherein the seat portion comprises a slot configured to permit water to drain therethrough and wherein the backrest portion is at an angle of 90° or greater and less than 180° relative to the top surface of the seat portion, and wherein each of the one or more corner chairs comprises a seat portion and two side portions, wherein the seat portion comprises a slot configured to permit water to drain therethrough and wherein the side portions intersect with the seat portion at an angle of 90° or greater and less than 180° relative to the top surface of the seat portion.
30. The assembly of furniture of one of paragraphs 27 to 29, in the form of a two-seat sofa, three-seat sofa, or four-seat sofa.
31. The assembly of furniture of any of paragraphs 27 to 30, further comprising an ottoman, wherein the ottoman comprises a seat portion.
32. A kit for forming a chair comprising:
   (i) a seat module comprising a seat portion, wherein the seat portion comprises a top opening, optionally in the form of a slot, configured to permit water to drain therethrough;
   (ii) a removable seat cushion, wherein the cushion has a suitable size and shape to fit on top of the seat portion, and wherein the cushion is attached to a plug, wherein the plug comprises a bottom portion, optionally in the form of a tab, wherein the bottom portion is configured for insertion in the top opening of the seat portion and is removable therefrom;
   (iii) a first leg module comprising a connecting bar and two legs, wherein each leg is attached to an opposite end of the connecting bar;
   (iv) a second leg module comprising a connecting bar and one leg or two legs; and
   (v) connecting elements.

33. A kit for forming a chair comprising:
   (i) a seat module comprising a seat portion, wherein the seat portion comprises a top opening, optionally in the form of a slot, configured to permit water to drain therethrough;
   (ii) a removable seat cushion, wherein the cushion has a suitable size and shape to fit on top of the seat portion, and wherein the cushion is attached to a plug, wherein the plug comprises a bottom portion, optionally in the form of a tab, wherein the bottom portion is configured for insertion in the slot of the seat portion and is slidably removable therefrom;
   (iii) a first leg module comprising a first connecting bar and two legs, wherein each leg is attached to an opposite end of the first connecting bar;
   (iv) a second leg module comprising a second connecting bar and a single leg attached to one end of the second connecting bar or two legs, wherein each leg is attached to an opposite end of the second connecting bar, and
   (v) two or more connecting elements configured to secure the first and second leg modules to the seat modules, optionally wherein the connecting elements are selected from the group consisting of attachment bars, connection plates, and fasteners.

34. The kit of paragraph 32 or 33, comprising two or more seat modules, wherein one or more of the seat modules has a different configuration from the other seat modules.

35. The kit of any one of paragraphs 32 to 34, wherein each seat module independently has a configuration selected from the group consisting of (a) an ottoman seat module, wherein the seat module does not contain a backrest portion or a side portion; (b) a side seat module, wherein the seat module comprises a backrest portion; and (c) a corner seat module, wherein the seat module comprises a backrest portion and a side portion, wherein for the side seat module and the corner seat module, the backrest portion and the side portion, if present, are each in a plane that intersects with the top surface of the seat portion at an angle of 90° or greater and less than 180°.

It is also to be understood that the terminology used herein is for the purpose of describing particular embodiments only and is not intended to be limiting.

It is also to be understood that the terminology used herein is for the purpose of describing particular embodiments only, and is not intended to limit the scope of the present invention which will be limited only by the appended claims.

It must be noted that as used herein and in the appended claims, the singular forms "a", "an", and "the" include plural reference unless the context clearly dictates otherwise.

Throughout the description and claims of this specification, the word "comprise" and variations of the word, such as "comprising" and "comprises," means "including but not limited to," and is not intended to exclude, for example, other additives, components, integers or steps.

"Optional" or "optionally" means that the subsequently described event, circumstance, or material may or may not occur or be present, and that the description includes instances where the event, circumstance, or material occurs or is present and instances where it does not occur or is not present.

Unless defined otherwise, all technical terms used herein have the same meanings as commonly understood by one of skill in the art to which the disclosed method and compositions belong.

Although the description of materials, compositions, components, steps, techniques, etc. may include numerous options and alternatives, this should not be construed as, and is not an admission that, such options and alternatives are equivalent to each other or, in particular, are obvious alternatives.

Those skilled in the art will recognize, or be able to ascertain using no more than routine experimentation, many equivalents to the specific embodiments of the method and compositions described herein. Such equivalents are intended to be encompassed by the following claims.

We claim:

1. A chair comprising a seat module and a removeable seat cushion, wherein the seat module comprises a seat portion wherein the seat portion comprises a top surface and a bottom surface, each comprising one or more openings configured to permit water to drain therethrough, wherein the one or more openings in the top surface is in fluid communication with the one or more openings in the bottom surface, wherein the seat cushion is releasably attached to a plug including a bottom portion that is configured to fit in one of the one or more openings in the top surface of the seat portion and be slidably removable therefrom, and wherein the bottom portion comprises at least one bottom channel configured to facilitate water flow through the one or more openings in the top surface of the seat portion.

2. The chair of claim 1, wherein the seat module further comprises a backrest portion, wherein the backrest portion is at an angle of 90° or greater and less than 180° relative to the top surface of the seat portion.

3. The chair of claim 1, wherein the seat cushion has a suitable size and shape to fit on top of the seat portion, wherein the bottom portion of the plug is in the form of a tab.

4. The chair of claim 3, wherein the removable seat cushion comprises a front portion and a back portion, wherein the back portion comprises at least one attachment region for releasably attaching to the plug.

5. The chair of claim 3, wherein the plug further comprises a top portion, wherein the top portion is releasably attached to the seat cushion.

6. The chair of claim 1, wherein the bottom side of the top portion of the plug comprises one or more top channels, wherein the top channels are in fluid communication with the bottom channels.

7. The chair of claim 1, further comprising three or four legs that descend from the seat module.

8. The chair of claim 1, further comprising two leg modules attached to the bottom of the seat portion, wherein each leg module comprises a connecting bar and a leg attached to one end of the connecting bar, optionally wherein at least one of the leg modules further comprises a second leg, and wherein each leg descends from the seat module.

9. The chair of claim 8, wherein the first leg module comprises two legs and each leg is attached to an opposite end of the connecting bar, and wherein the second leg module comprises a single leg attached to one end of the connecting bar or wherein the second leg module comprises two legs and each leg is attached to an opposite end of the connecting bar.

10. The chair of claim 2, wherein the backrest portion comprises one or more back openings.

11. The chair of claim 10, further comprising a removable back cushion, wherein the back cushion is attached to a plug, wherein the plug comprises a bottom portion, wherein the bottom portion is configured for insertion in one of the one or more back openings and is slidably removable therefrom.

12. The chair of claim 2, further comprising one or two side portions, wherein each of the side portions intersects with the seat portion at the same angle as the backrest portion.

13. The chair of claim 12, in the form of an armchair, wherein the chair comprises two side portions.

14. An assembly of furniture comprising at least two chairs and a removeable seat cushion, wherein the chairs are in the form of one or more corner chairs, one or more side chairs, or a combination thereof, wherein each of the one or more side chairs comprises a first seat portion and a backrest portion, wherein the first seat portion comprises a top surface and a bottom surface, each comprising one or more openings configured to permit water to drain therethrough, wherein the one or more openings in the top surface is in fluid communication with the one or more openings in the bottom surface, and wherein the backrest portion is at an angle of 90° or greater and less than 180° relative to the top surface of the seat portion, wherein each of the one or more corner chairs comprises a second seat portion and two side portions, wherein the second seat portion comprises a slot configured to permit water to drain therethrough, and wherein the side portions intersect with the seat portion at an angle of 90° or greater and less than 180° relative to the top surface of the seat portion, and wherein the seat cushion is releasably attached to a plug including a bottom portion that is configured to fit in one of the one or more openings in the top surface of the seat portion and be slidably removable therefrom, and wherein the bottom portion comprises at least one bottom channel configured to facilitate water flow through the one or more openings in the top surface of the seat portion.

15. The assembly of furniture of claim 14 in the form of a two-seat sofa, three-seat sofa, or four-seat sofa.

16. The assembly of furniture of claim 14, further comprising an ottoman, wherein the ottoman comprises a seat portion.

17. A kit for forming a chair comprising:

(i) a seat module comprising a seat portion, wherein the seat portion comprises a top surface and a bottom surface, each comprising one or more openings configured to permit water to drain therethrough; wherein the one or more openings in the top surface is in fluid communication with the one or more openings in the bottom surface;

(ii) a removable seat cushion, wherein the cushion has a suitable size and shape to fit on top of the seat portion, and wherein the cushion is releasably attached to a plug, wherein the plug comprises a bottom portion, wherein the bottom portion is configured for insertion in one of the one or more openings in the top surface of the seat portion and is slidably removable therefrom, and wherein the bottom portion comprises at least one bottom channel configured to facilitate water flow through the one or more openings in the top surface of the seat portion;

(iii) a first leg module comprising a first connecting bar and two legs, wherein each leg is attached to an opposite end of the first connecting bar;

(iv) a second leg module comprising a second connecting bar and a single leg attached to one end of the second connecting bar or two legs, wherein each leg is attached to an opposite end of the second connecting bar, and (v) connecting elements configured to secure the first and second leg modules to the seat modules, optionally wherein the connecting elements are selected from the group consisting of attachment bars, connection plates, and fasteners.

18. The kit of claim 17, comprising two or more seat modules, wherein one or more of the seat modules has a different configuration from the other seat modules.

19. The kit of claim 17, wherein each seat module independently has a configuration selected from the group consisting of (a) an ottoman seat module, wherein the seat module does not contain a backrest portion or a side portion; (b) a side seat module, wherein the seat module comprises a backrest portion; and (c) a corner seat module, wherein the seat module comprises a backrest portion and a side portion, wherein for the side seat module and the corner seat module, the backrest portion and the side portion, if present, are each in a plane that intersects with the top surface of the seat portion at an angle of 90° or greater and less than 180°.

20. The chair of claim 1, wherein at least one of the one or more openings is in the form of a slot, and wherein the bottom portion of the plug is configured to fit in the slot.

* * * * *